US005406888A

United States Patent [19]

Sugiyama et al.

[11] Patent Number: 5,406,888

[45] Date of Patent: Apr. 18, 1995

[54] AUTOMATIC PLATE REPLACING APPARATUS FOR PRINTING PRESS

[75] Inventors: Hiroyuki Sugiyama; Toshio Miyamoto; Norio Hirose, all of Ibaraki, Japan

[73] Assignee: Komori Corporation, Tokyo, Japan

[21] Appl. No.: 133,758

[22] Filed: Oct. 7, 1993

Related U.S. Application Data

[63] Continuation of Ser. No. 941,775, Sep. 4, 1992, abandoned, which is a continuation of Ser. No. 619,120, Nov. 28, 1990, abandoned.

[30] Foreign Application Priority Data

Dec. 6, 1989 [JP] Japan ..... 1-315380
Apr. 3, 1990 [JP] Japan ..... 2-35417 U
Apr. 3, 1990 [JP] Japan ..... 2-87438

[51] Int. Cl.[6] ..... B41F 27/06; B41L 29/16
[52] U.S. Cl. ..... 101/415.1; 101/477
[58] Field of Search ..... 101/415.1, 477, 216, 101/DIG. 36, 378

[56] References Cited

U.S. PATENT DOCUMENTS 4,669,380 6/1987 Seib et al. ..... 101/216
4,727,807 3/1988 Suzuki et al. ..... 101/415.1
4,858,528 8/1989 Inouye et al. ..... 101/415.1
5,218,907 6/1993 Komori et al. ..... 101/477

FOREIGN PATENT DOCUMENTS 61-227056 10/1986 Japan .
62-62759 3/1987 Japan .

*Primary Examiner*—J. Reed Fisher
*Attorney, Agent, or Firm*—Blakely, Sokoloff, Taylor & Zafman

[57] ABSTRACT

A plate replacing apparatus for a printing press having plate lockup devices for fixing the two ends of a plate located in a gap of the circumferential surface of a plate cylinder and wound around the circumferential surface includes an old plate holding mechanism and a new plate holding mechanism. The old plate holding mechanism receives and holds an old plate removed upon release of the plate lockup devices and pivotal movement of the plate cylinder. The new plate holding mechanism removes the old plate and feeds a new plate to the plate cylinder.

7 Claims, 16 Drawing Sheets

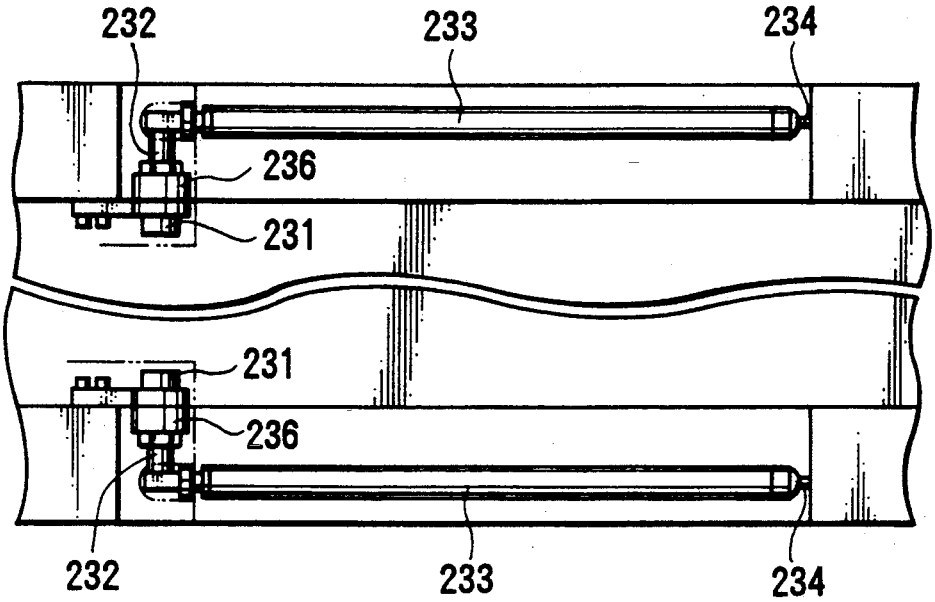
FIG.14
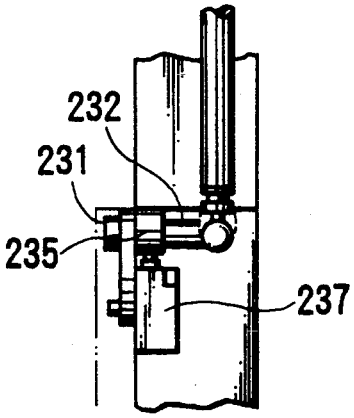
FIG.15
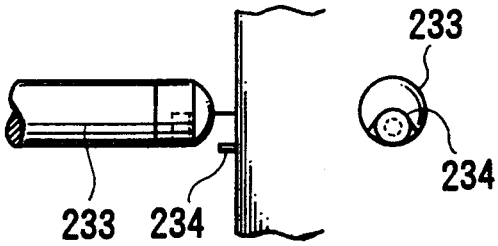
FIG.16B
FIG.16A

AUTOMATIC PLATE REPLACING APPARATUS FOR PRINTING PRESS

This is a continuation of application Ser. No. 07/941,775, filed Sep. 4, 1992, now abandoned, which is a continuation of Ser. No. 07/619,120, filed Nov. 28, 1990, now abandoned.

BACKGROUND OF THE INVENTION

The present invention relates to a plate replacing apparatus for replacing an old plate mounted on the circumferential surface of a plate cylinder by a plate lockup apparatus with a new plate prepared outside the plate replacing apparatus.

A gap is formed along the entire length in the outer circumference of each plate cylinder in a printing press. A plate lockup apparatus consisting of a leading-side lockup device for gripping the leading edge of the plate and a trailing-side lockup device for gripping the trailing edge of the plate is fixed on the bottom surface of the gap to extend in the axial direction of the plate cylinder.

Each of the conventional leading- and trailing-side lockup devices comprises an elongated lockup table extending in the axial direction of the plate cylinder, a plurality of gripper plates, swingably supported at an edge portion of this lockup table by a plurality of bolts, for gripping or releasing the plate with or from the lockup table, and a plurality of cams which can be respectively engaged with gaps at the edges of the gripper plates. The plurality of cams are pivotally aligned along the axis. A plurality of compression coil springs are interposed between the lockup table and the gripper plates to bias the gripper plates in an open direction.

With the above arrangement, in order to mount a plate on a plate cylinder, when a cam shaft of the leading-side lockup device is pivoted, the gripper plates which are divided in the axial direction of the plate are released upon disengagement from the cams and are simultaneously opened by the elastic forces of the compression coil springs. An end of the plate is inserted between the leading-side lockup device and the corresponding lockup table. When the cam plate is pivoted in the direction opposite to the direction described above, the gripper plates are pivoted against the elastic forces of the compression coil springs by the behavior of the cams and are closed, thereby gripping the leading edge of the plate.

Another conventional apparatus is disclosed in Japanese Patent Laid-Open No. 1-127346. In this apparatus, the lockup tables and the gripper plates are disposed in the radial direction of a plate cylinder so that a trailing-side gripper surface of the plate conventionally formed in the circumferential direction of the plate cylinder is formed in the radial direction of the plate cylinder. The edge of the plate is bent at a right angle by an external bending machine. With this arrangement, after the leading edge of the plate is gripped, the bent portion of the trailing edge portion of the plate wound around the circumferential surface of the plate is inserted between the lockup tables and the gripper plates. The gripper plates are swung by a cam mechanism to grip the bent portion of the plate. The trailing-side lockup device as a whole is circumferentially moved to uniformly mount the plate, thereby bringing the plate into tight contact with the surface of the plate cylinder.

In such a conventional press, when an old plate is replaced with a new plate due to changes in contents of printed matters, the trailing-side cam shaft is pivoted to open the trailing-side lockup device. One end of the plate which is released from gripping is kept held, and the plate cylinder is rotated. The leading-side cam shaft is pivoted to open the leading-side lockup device to release the other end of the plate from gripping, thereby removing the old plate. Thereafter, opening/closing of the plate lockup devices and the pivotal operation of the plate cylinder are repeated to mount the new plate.

In plate replacement in the conventional printing press, however, pivotal movement of the cam shaft and rotation of the plate cylinder must be performed manually or upon operation of a push button. Plate replacement is cumbersome and requires skills since the old and new plates must be manually held. In addition, the new plate cannot be placed to stand by at a mounting position of the plate cylinder during printing. The old plate must be removed from the press during the replacement. A preparation period is therefore undesirably prolonged, and productivity is degraded. In addition, automatic plate replacement cannot be performed due to a requirement of plate holding.

SUMMARY OF THE INVENTION

It is an object of the present invention to provide a plate replacing apparatus for a printing press, capable of greatly shortening a preparation time, improving productivity, and reducing labor.

It is another object of the present invention to provide a plate replacing apparatus for a printing press, capable of facilitating maintenance and inspection and improving operability.

It is still another object of the present invention to provide a plate replacing apparatus for a printing press, capable of improving safety in operations.

In order to achieve the above objects of the present invention, there is provided a plate replacing apparatus for a printing press having plate lockup devices for fixing the two ends of a plate located in a gap of a circumferential surface of a plate cylinder and wound around the circumferential surface, comprising an old plate holding mechanism for receiving and holding an old plate removed upon release of the plate lockup devices and pivotal movement of the plate cylinder, and a new plate holding mechanism for removing the old plate and feeding a new plate to the plate cylinder.

At the time of plate replacement, the distal end portion of the loader which holds the new plate in advance during printing is brought into contact with the outer circumferential surface of the plate cylinder. The plate cylinder is stopped at a position where the trailing-side plate lockup device opposes the distal end portion of the plate holding apparatus. The leading- and trailing-side plate lockup devices are opened, and the plate cylinder is rotated by about one revolution. The old plate is moved into the loader and is held in it. The plate cylinder is then pivoted to cause the leading-side plate lockup device to oppose the distal end portion of the loader and to push the new plate, and the plate lockup apparatus is closed to grip one end of the new plate in the leading-side plate lockup device. The plate cylinder is rotated by about one revolution, and the trailing-side plate lockup device is closed, thereby mounting the new plate on the plate cylinder.

According to the present invention, the loader is pivoted to bring its distal end portion to oppose the plate lockup device. In this case, when the safety bar in the safety unit is kept open, the switch is kept OFF and the loader is not pivoted. However, when the safety bar is closed, the loader is pivotal. In this case, the operator cannot enter a working space between the printing units due to the presence of the safety bar, thereby ensuring a safe operation.

According to the present invention, at the time of plate replacement, the loader is pivoted to be stored and suspended so that its distal end portion is separated from the plate lockup apparatus. At the time of maintenance and inspection of the dampening unit and supply of dampening water, the loader in the storage state is moved upward, so that the working surface of the dampening unit is opened, thereby facilitating the operations.

BRIEF DESCRIPTION OF THE DRAWINGS

FIGS. 1 to 12H show an embodiment of a plate holding unit according to the present invention, in which FIG. 1 is a plan view of a plate cylinder which employs the plate holding unit, FIG. 2 is a sectional view of the plate cylinder along the line II—II in FIG. 1, FIG. 3 is a sectional view of the plate cylinder along the line III—III in FIG. 1, FIG. 4 is a sectional view of the plate cylinder along the line IV—IV in FIG. 1;

FIG. 5 is a sectional view of the plate cylinder along the line V—V in FIG. 1, FIG. 6 is a longitudinal sectional view of a trailing-side plate lockup device before a plate is gripped, FIG. 7 is a side view of a plate lockup opening/closing unit, FIG. 8 is a partially cutaway side view of an upper half of the plate holding unit, FIG. 9 is a partially cutaway side view of a lower half of the plate holding unit, FIG. 10 is a side view showing the plate holding unit, FIG. 11 is a side view showing the main part of a plate replacing apparatus which employs the present invention, and FIGS. 12A to 12H are side views showing plate replacing states of the plate replacing apparatus;

FIGS. 13 to 17 show a plate replacing apparatus according to another embodiment of the present invention, in which FIG. 13 is a front view of the plate replacing apparatus, FIG. 14 is a plan view thereof, FIG. 15 is a side view thereof along the line XIII in FIG. 13, FIGS. 16A and 16B are an enlarged front view and a front view, respectively, of a bar distal end portion, and FIG. 17 is a front view showing a four-color sheet fed press which employs the present invention; and FIGS. 18 to 22 show a plate replacing apparatus according to still another embodiment of the present invention, in which FIG. 18 is a front view of the plate replacing apparatus, FIG. 19 is an enlarged plan view thereof along the line XIX in FIG. 18, FIG. 20 is an enlarged side view thereof along the line IIX in FIG. 18, FIG. 21 is an enlarged side view showing a partially cutaway section along the line IIXI in FIG. 18, and FIG. 22 is a front view of the plate replacing apparatus in a state wherein a plate holding member is kept at an upper position.

DESCRIPTION OF THE PREFERRED EMBODIMENTS

Figure 1:
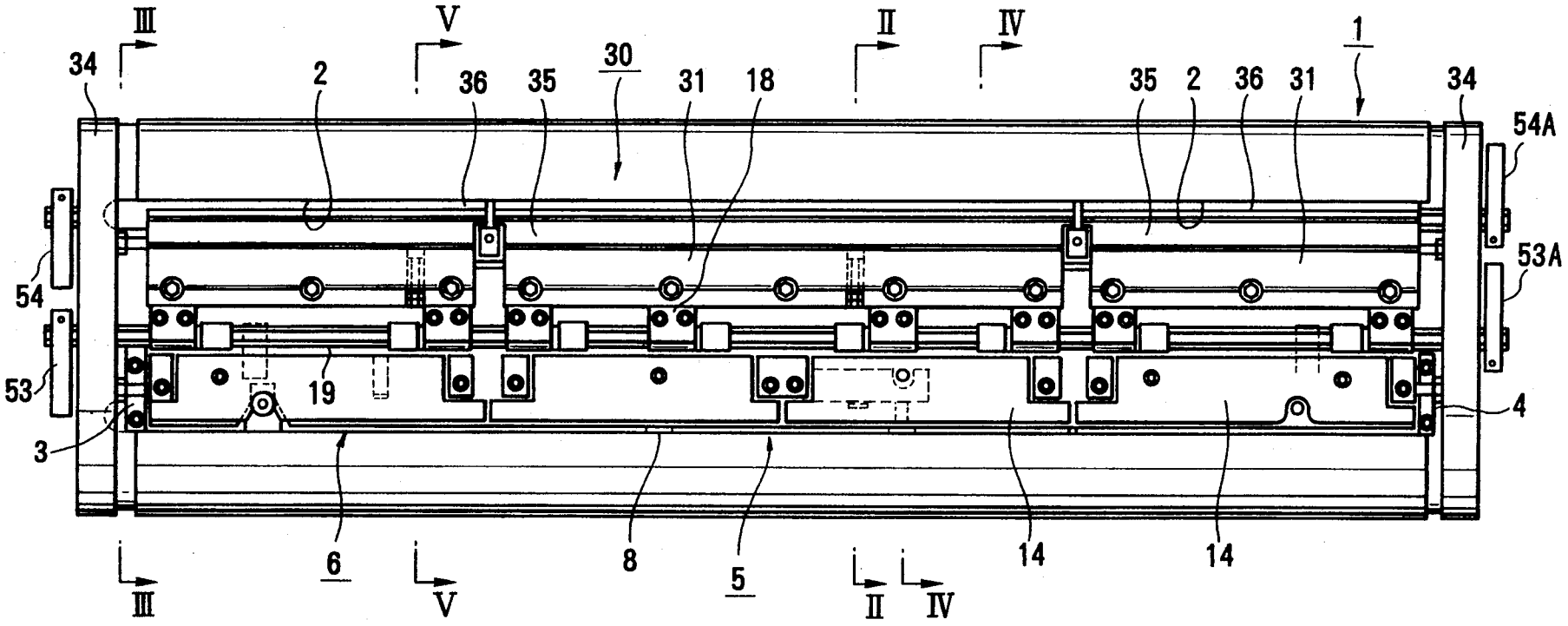
Figure 2:
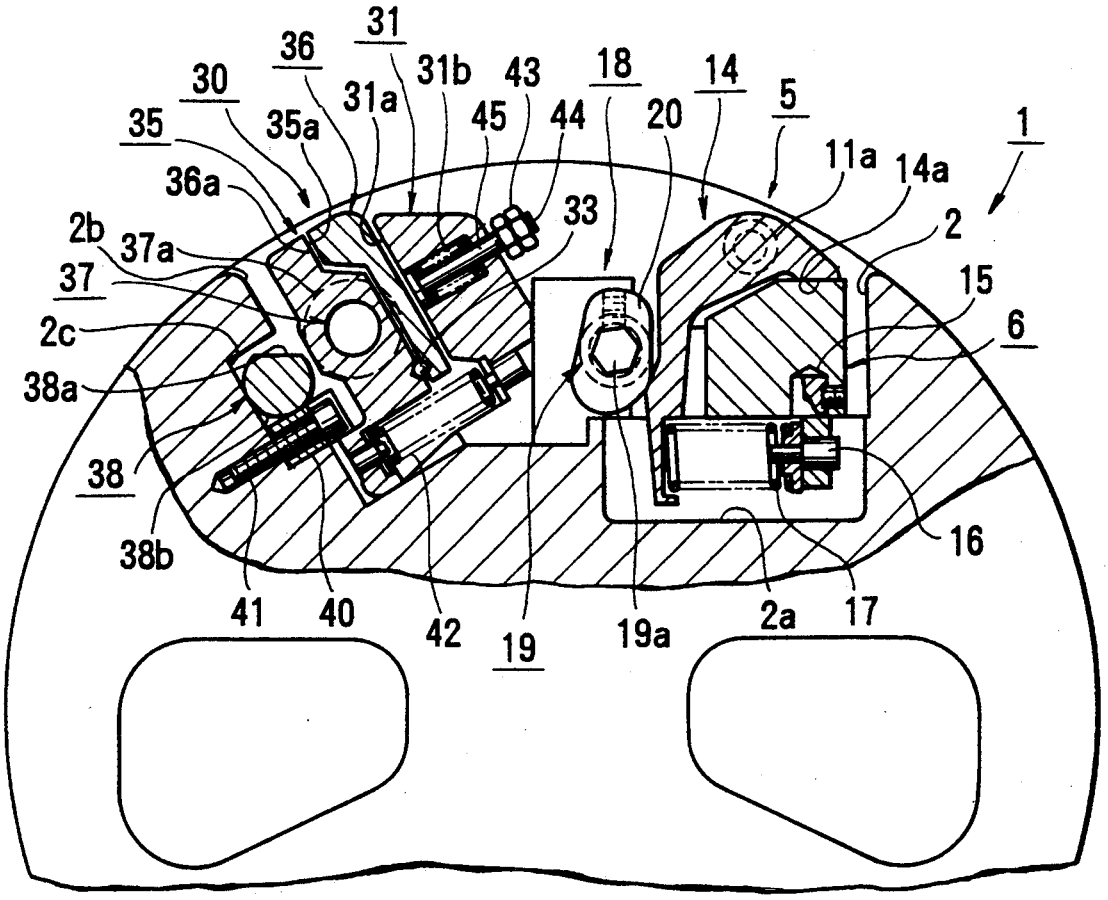
Figure 3:
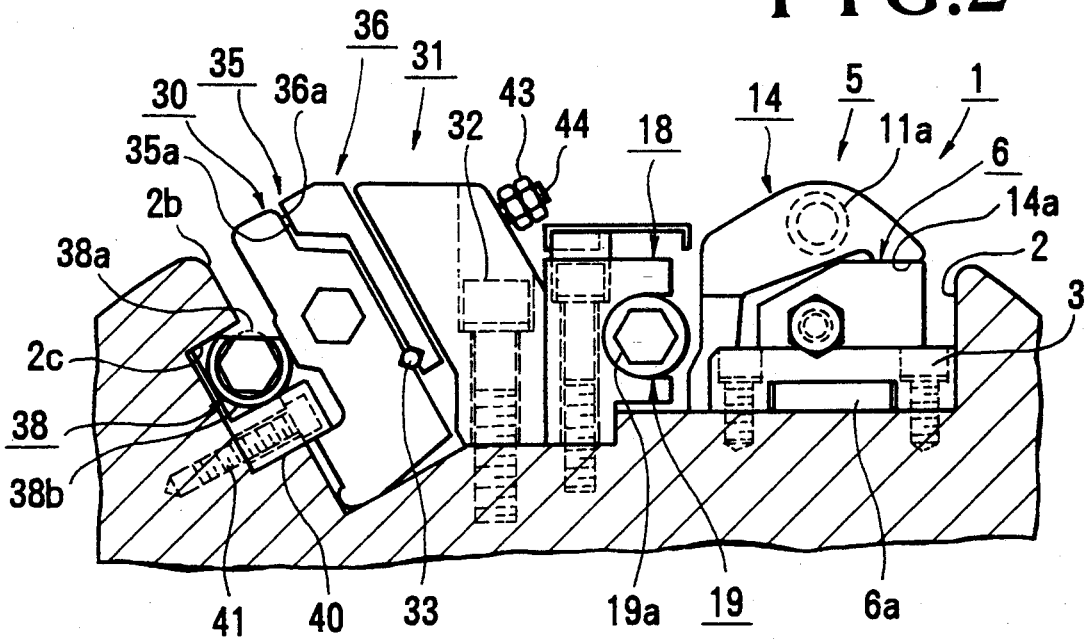
Figure 4:
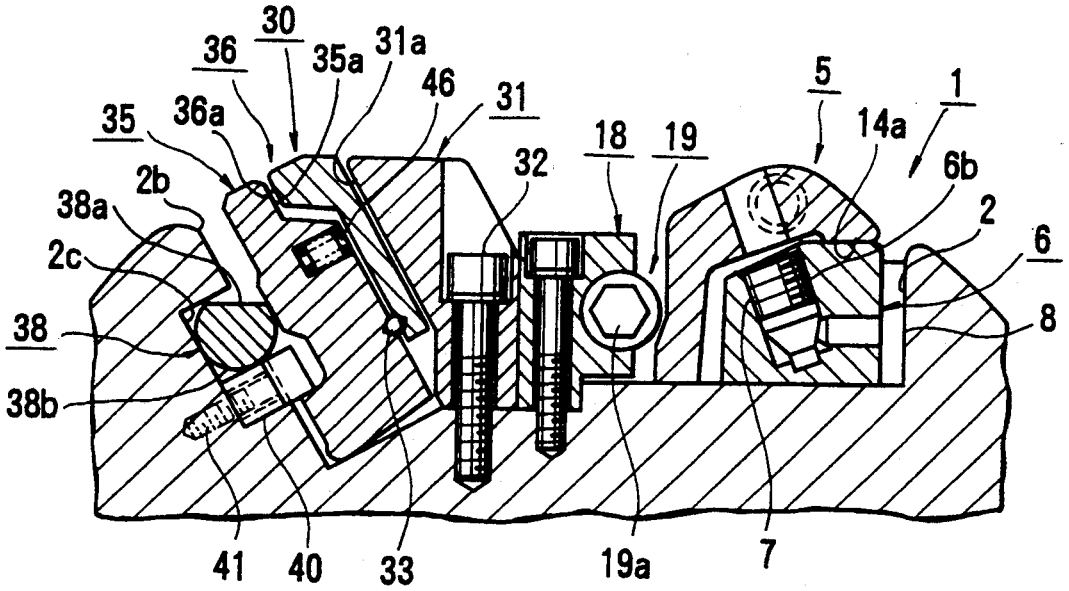

FIGS. 1 to 12H show an embodiment in which a plate holding apparatus according to the present invention is employed in an automatic plate replacing apparatus.

A gap 2 having a substantially rectangular sectional shape is formed in the outer circumferential surface of a plate cylinder 1 along the entire length of the plate cylinder 1. Saddle-like guides 3 and 4 are bolted on the bottom surface portions of the gap 2 at its two ends. A leading-side plate lockup device 5 comprises a lockup table 6 having an almost square sectional shape and extending in the axial direction of the plate cylinder. Thin-walled portions **6*a* at the two ends of the lockup-device 6 are fitted to be slightly circumferentially movable while their vertical movement is restricted by the left and right guides 3 and 4. An intermediate portion of the lockup table 6 is slidably pressed by a plurality of guides (not shown) fixed on the bottom surface of the gap 2, so that floating of the lockup table 6 is prevented. A plurality of screw holes 6*b* are formed in portions along the longitudinal direction of the lockup table 6 and each has a section shown in FIG. 4. An adjusting screw 7 whose distal end is tapered is threadably engaged with a corresponding one of the screw holes 6*b*. A collared pin 8, the collar portion of which is fitted between the lockup table 6 and the gap 2, is slidably inserted in each pin hole corresponding to each of the adjusting screws 7. The distal end of the collared pin 8 abuts against a tapered surface of the corresponding adjusting screw 7. With this arrangement, when the adjusting screw 7 is turned, the lockup table 6 is slightly moved in the circumferential direction by the behavior of the tapered surface. A compression coil spring 9 in FIG. 5 is inserted between a stud 10 on the lockup table 6 and the wall surface of a recessed hole 2*a* of the gap 2 to bias the lockup device 5** outward.

Figure 5:
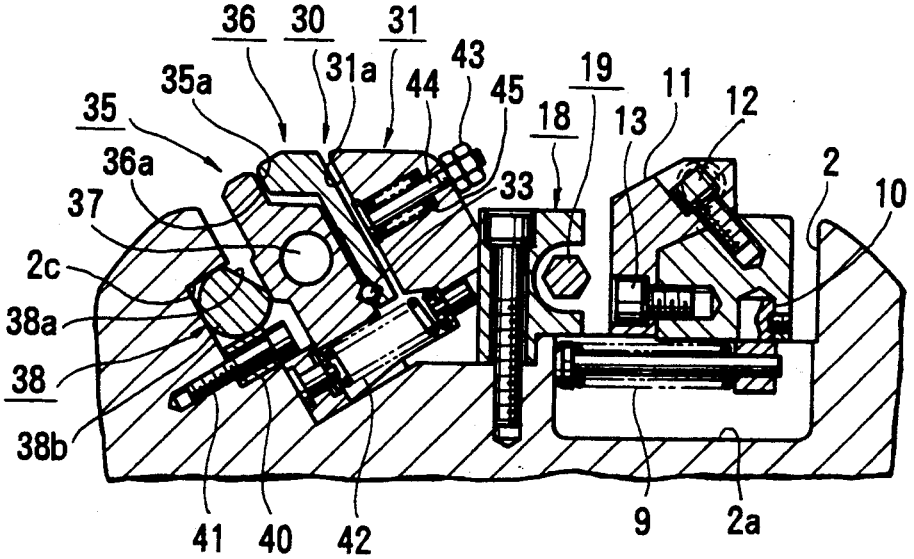
Figure 6:
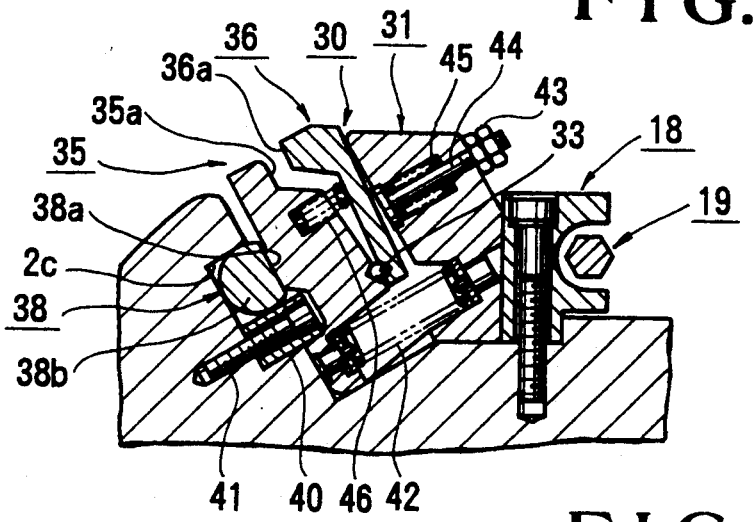

An L-shaped leading-side plate holder 11 shown in FIG. 5 is fixed by bolts 12 and 13 on the inclined surface of the lockup table 6. Three gripper plates 14 having a substantially V-shaped section, divided in the axial direction of the plate cylinder, and constituting the same overall length as that of the lockup table 6 are swingably supported on pins **11*a* horizontally extending from the plate holders 11. A gripper surface 14*a* of each gripper plate 14 opposes the gripper surface of the lockup table 6. Although not shown, a plurality of projections are formed on the gripper surface 14*a* and are engaged with the recesses formed in the opposite gripper surface. A plurality of studs 15 each having a sectional shape shown in FIG. 2 extend upward from the bottom surface of the lockup table 6 and are aligned in the axial direction of the plate cylinder to extend into the recessed hole 2*a* of the gap 2. A compression coil spring 17 is inserted between a spring reception pin 16 threadably engaged with a screw hole of each stud 15 and the gripper plate 14 to bias the gripper plate 14 in a direction so that the gripper surface 14*a* of the gripper plate 14** is closed.

A plurality of bearings 18 having a rectangular parallelepiped shape are fixed by bolts at the central part of the bottom surface of the gap 2 and are aligned along the axial direction of the plate cylinder. A hexagonal cam shaft 19 is fitted in the bearings 18. A plurality of plate gripper cams 20 each having large- and small-diameter portions are mounted on the cam shaft 19 in tandem with each other. The cam surface of each plate gripper cam 20 is in contact with a vertical surface of the corresponding gripper plate 14. Upon driving of the cam shaft 19 by a drive unit (to be described later), the large-diameter portions of the plate gripper cams 20 cause the gripper plates 14 to pivot in the counterclockwise direction against the biasing forces of the compression coil springs 17, so that the gripper surfaces 14*a* are opened.

A Trailing-side plate lockup device 30 is arranged parallel to the leading-side lockup device 5 within the gap 2. The trailing-end lockup device 30 comprises a spring reception bar 31 having almost the same length as the overall length of the plate cylinder and a vertical surface which is in contact with the vertical surface of the corresponding bearing 18. The spring reception bar 31 is fixed on the bottom surface of the gap 2 by a plurality of bolts 32. The spring reception bar 31 comprises a regulation surface 31*a* extending in the radial direction of the plate cylinder 1. A support shaft 33 extends between the regulation surface 31*a* and a wall surface 2*b* of the gap 2 so that the two ends of the support shaft 33 are located near disc bearers 34 at the two ends of the plate cylinder 1. Three separated lockup tales 35 and three separating gripper plates 36 have opposite gripper surfaces 35*a* and 36*a* extending in the radial direction of the plate cylinder 1 so that ends of the lockup tables 35 and the gripper plates 36 opposite to these gripper portions are swingably connected to each other through the support shaft 33. Reference numerals 37 denote adjusting screws for connecting the three separated lockup tables 35. Right- and left-hand threads are threadably engaged with screw holes of each lockup table 35. A tool is inserted into a hole of a collar portion 37*a* integrally formed between the two adjacent lockup tables 35 and is turned to adjust a distance between the adjacent lockup tables 35.

A rod-like cam 38 formed by a planar small-diameter portion 38*a* and an arcuated large-diameter portion 38*b* is pivotally mounted on the bearer 34 in a recessed portion 2*c* formed in the wall surface 2*b* of the gap 2. An extended portion 38*c* of the cam 38 from the bearer 34 has a hexagonal shape. Reference numeral 40 denotes a guide for pivoting the cam 38 and is fixed in the recessed portion 2*c* of the wall surface 2*b* by a bolt 41. Compression coil springs 42 are interposed between a plurality of spring hole bottom surfaces formed in the non-gripper ends of the lockup tables 35 and the plurality of spring hole bottom surfaces formed in the spring reception bar 31 to separate the lockup tables 35 from the spring reception bar 31. A compression coil spring 45 is interposed between the bottom surface of a spring hole 31*b* and a collar portion of a spring shaft 44 whose movement is limited by a double nut 43 slidably mounted in the spring hole 31*b* of the upper portion of the spring reception bar 31, and separates each gripper plate 36 from the spring reception bar 31. A compression coil spring 46 is arranged within the spring hole of the upper portion of each lockup table 35 to bias this lockup table 35 from the corresponding gripper plate 36. Reference numeral 47 denotes a blanket cylinder which is brought into rolling contact with the plate cylinder 1.

An opening/closing drive unit for pivoting the cam shaft 19 and the cam 38 to open/close each plate gripper surface will be described below. Each opening/closing drive unit is arranged near each of right and left frames 50 for supporting the plate cylinder 1 and the blanket cylinder 47. The right drive unit (the left-hand unit in FIG. 1 for illustrative convenience) on the right frame 50 when viewed from the sheet feeder will be described first. An air cylinder 51 serving as a drive unit is swingably supported on the upper end face of the frame 50 through a bracket 52. Levers 53 and 54 are split-fixed on the leading-side cam shaft 19 and the trailing side cam 38 between the bearer 34 and the frame 50. A link mechanism 55 is arranged between the air cylinder 51 and the levers 53 and 54. The distal end portion of a rod 57 connected to a piston rod 56 of the air cylinder 51 is connected to a free end portion of an L-shaped lever 59 pivotally supported on the upper surface of the frame 50 through a bracket 58. The lower end portion of a rod 60 whose upper end is connected to the other free end portion of the L-shaped lever 59 is connected to a free end portion of a lever 62 supported on a stud 61 of the frame 50. A lever 63 is formed integrally with the lever 62. A free end portion of the lever 63 is connected to one end of a roller lever 64. Reference numeral 65 denotes a lever shaft pivotally supported between the right and left frames so that axial movement of a lever 66 pivotally mounted thereon is limited. A free end portion of the lever 66 is supported by the central portion of the roller lever 64. That is, a four-joint link is constituted by the levers 63 and 66 and the roller lever 64. When the lever 62 is driven by the air cylinder 51 and is swung, the roller lever 64 is reciprocated together with the levers 63 and 66 in the radial direction of the plate cylinder 1. A roller 67 which is selectively brought into contact with the lever 53 or 54 in accordance with a pivotal phase of the plate cylinder 1 is mounted on the distal end portion of the roller lever 64. When the roller lever 64 is reciprocated, the lever 53 or 54 is pivoted about the cam shaft 19 or the cam 38 within the range between the solid line and the alternate long and short dashed line in FIG. 7.

In the right opening/closing drive unit, when the lever 53 is located at the position indicated by the solid line, the plate gripper surfaces of the leading-side lockup device 5 are closed. However, when the lever 54 is located at the position indicated by the solid line, the plate gripper surfaces of the trailing-side lockup device 30 are open.

Figure 7:
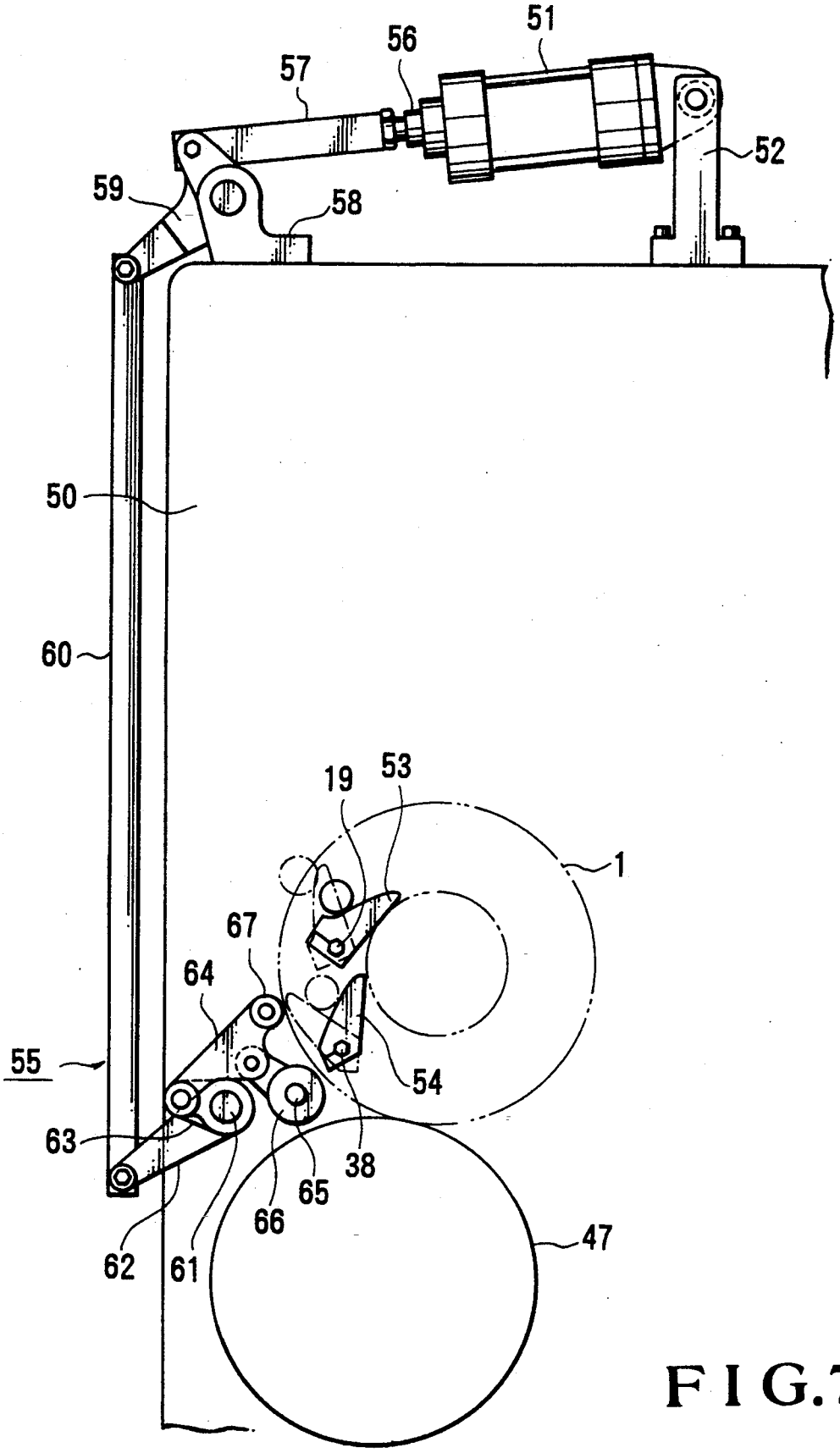
Figure 8:
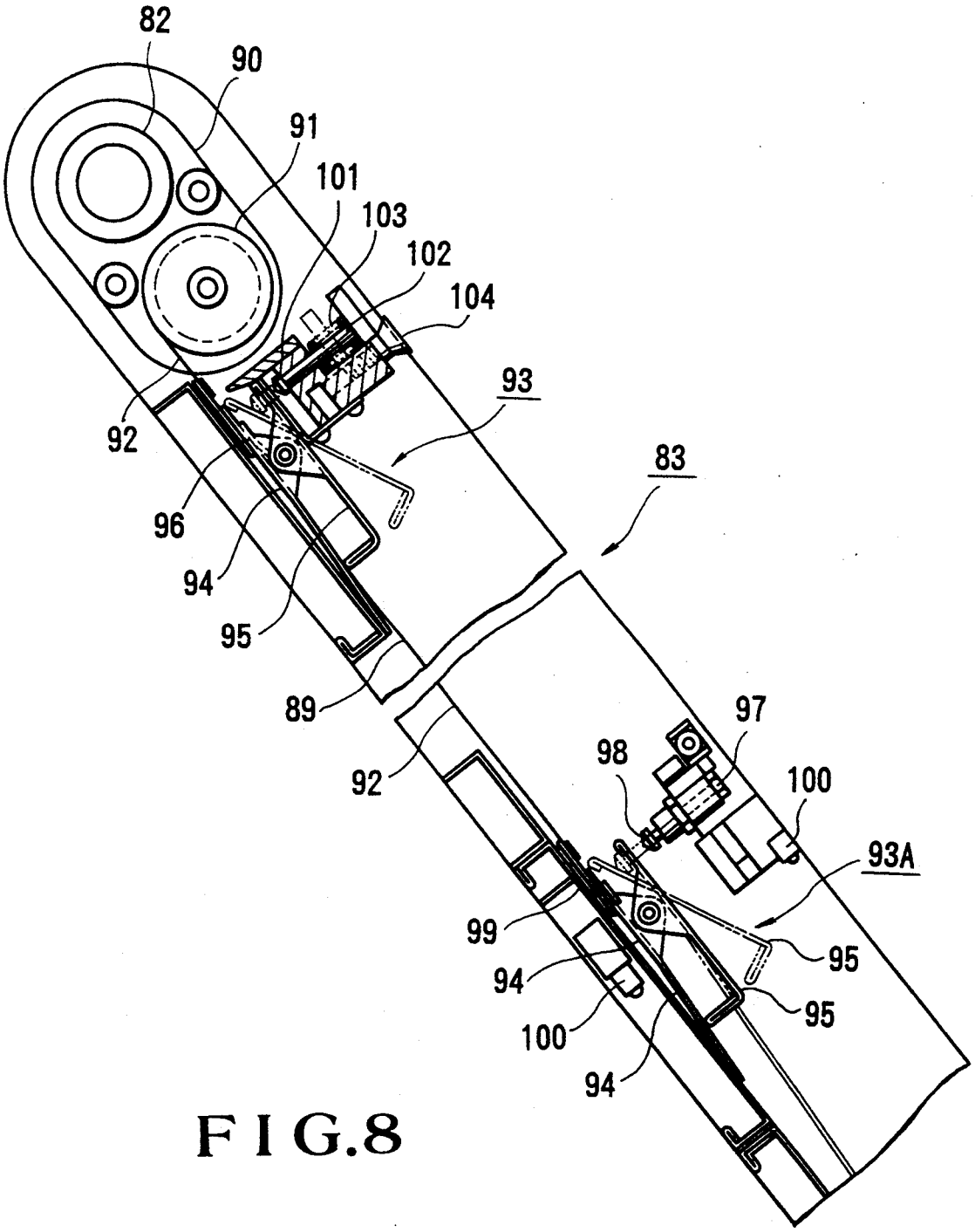

The left opening/closing drive unit (the right drive unit in FIG. 1) on the left frame side when viewed from the sheet feeder is arranged similarly to the right opening/closing drive unit, although the left opening/closing drive unit is not illustrated in FIG. 7. The arrangement of the left opening/closing drive unit is the same as that of the right opening/closing drive unit as far as the components from the air cylinder 51 to the roller 67 are concerned. The arrangement of the left opening/closing drive unit is different from that of the right opening/closing drive unit in levers 53 and 54. That is, as shown in FIGS. 1 and 7, the right levers 53 and 54 extend upward from the cam shaft 19 and the cam 38. However, in the left opening/closing drive unit, levers 53A and 54A in FIG. 1 extend downward from the cam shaft 19 and the cam 38. That is, the distal end portion of the right trailing-side lever 54 and the distal end portion of the left leading-side lever 53A are in phase in the circumferential direction and oppose the rollers 67. With this arrangement, when the right and left air cylinders 51 are simultaneously actuated, the lever 54 is pressed by the right roller 67 to open the plate gripper surfaces of the trailing-side plate lockup device 30. At the same time, the left lever 53A is pressed by the left roller 67. At the same time, the right lever 54 is moved from the position of the solid line to the position of the alternate long and short dashed line, so that the plate gripper surfaces of the leading-side plate lockup device 5 are opened.

Figure 11:
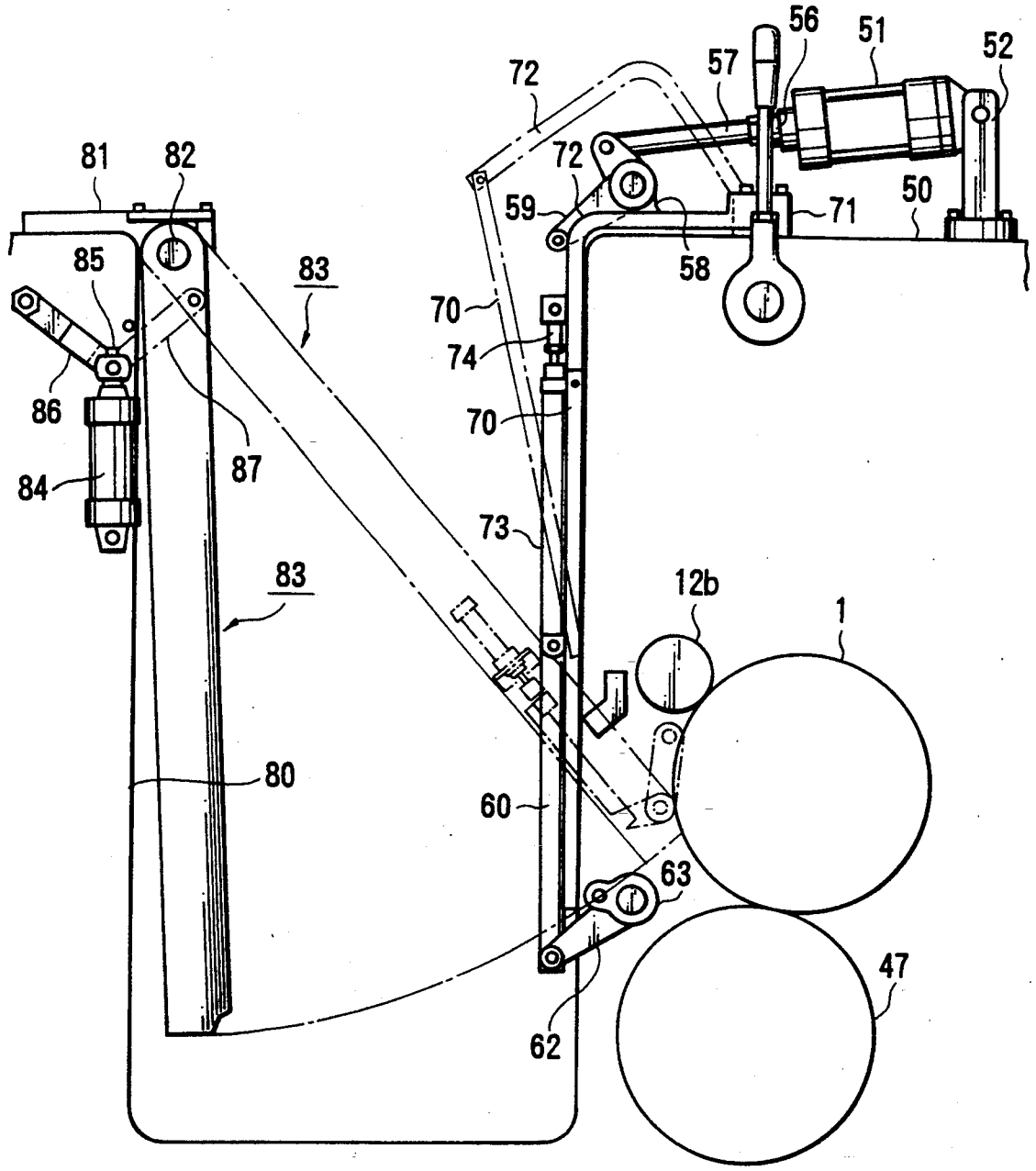

Reference numeral 70 in FIG. 11 denotes a cover for covering the front side of the plate cylinder 1 throughout its entire length. The cover 70 is pivotally supported on a free end portion of an L-shaped lever 72 pivotally supported on the upper end surface of the frame 50 through a bracket 71. An actuation end of a piston rod 74 of an air cylinder 73 pivotally supported on the frame 50 is mounted on the L-shaped lever 72. With this arrangement, when the air cylinder 73 is actuated in response to a command from a control unit, the cover 71 is moved in the range of the position indicated by the solid line and the position indicated by the alternate long and short dashed line.

A plate replacing apparatus for replacing an oil plate with a new plate is arranged in the plate lockup apparatus and the opening/closing unit. That is, a pair of right and left brackets 81 are located obliquely above the plate cylinder 1 and are mounted on the upper ends of the rear sides of right and left frames 80 mounted in a printing unit in front of the frames 50. The proximal end of a loader 83 serving as a plate holding member having a rectangular member whose long sides are aligned in the horizontal direction and having almost the same length as the plate cylinder is mounted on a support shaft 82 pivotally mounted on these brackets 81. An air cylinder 84 connected to the control unit is pivotally supported on the right and left frames 80 near the brackets 81. A lever 86 supported by the frame 80 and a lever 87 supported on the loader 83 are connected to an actuation end of a piston rod 85 of the air cylinder 84. With this arrangement, when the piston rod 85 of the air cylinder 84 is reciprocated, the loader 83 is swung through the levers 86 and 87 between a suspended position indicated by the solid line and an inclined position indicated by the alternate long and short dashed line, so that the distal end portion of the loader 83 comes close to or is separated from the circumferential surface of the plate cylinder 1.

Figure 9:
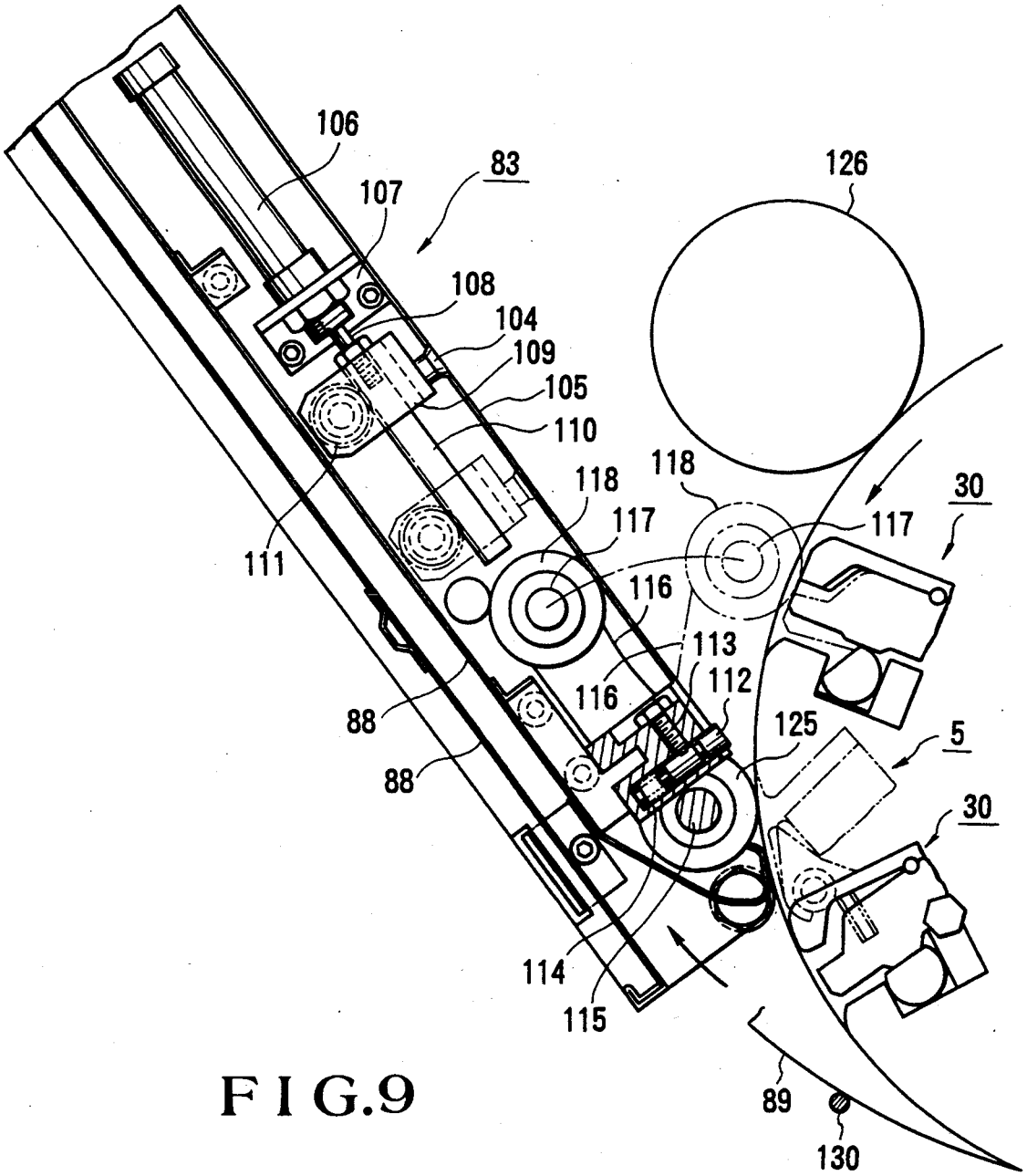
Figure 10:
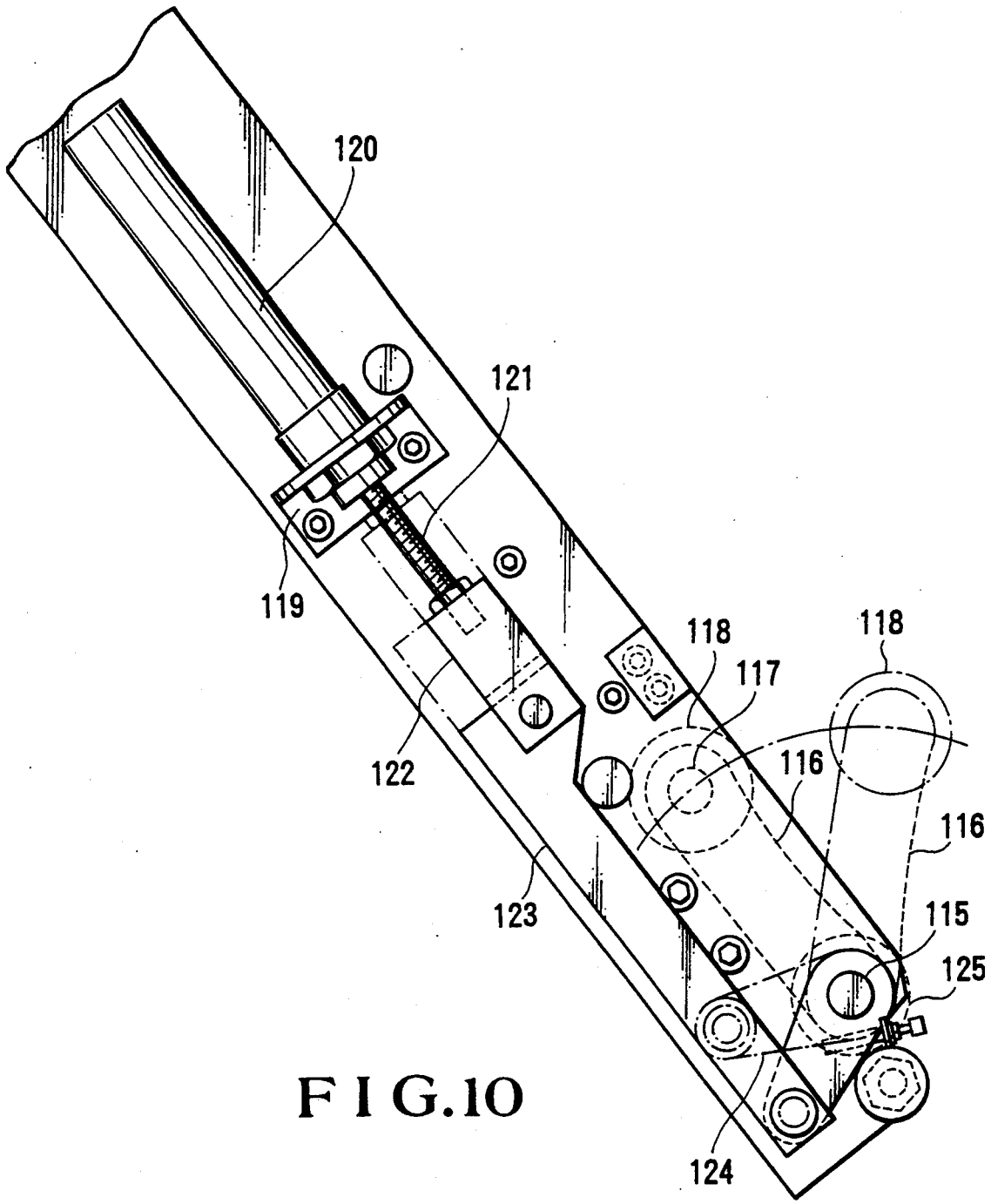

As shown in FIG. 9, two guide plates 88 having a V-shaped inlet vertically extend in the lower half of the loader 83. When the plate lockup device 30 is opened, a plate 89 released and rewound upon pivotal movement of the plate cylinder 1 is inserted between the guide plates 88 in a direction indicated by an arrow. A plurality of pairs of brackets 90 each having an oval shape are fixed on the tubular support shaft 82 in the upper end portion of the loader 83 at positions obtained by dividing the overall width of the loader 83 into $\frac{1}{3}$. Convex members 91 are supported on the respective pairs of brackets 90. Each convex member 91 has a band-like leaf spring 92 biased in a direction to wind the convex 91. The fixed end of the leaf spring 92 is fixed to a plate trailing edge holding unit 93. An L-shaped plate hook 95 which is held in an upright position (position of the solid line) by a biasing force of a coil spring 96 is pivotally supported in a holder 94 at the end of the leaf spring 92. A bent portion of the plate 89 entering between the guide plates 88 is hooked by a hook portion of the plate hook 95. That is, prior to the start of replacement of the plate 89, the plate trailing edge holding unit 93 is manually moved downward to the central standby position of the loader 83, and a piston rod 98 of an air cylinder 97 arranged at this standby position is moved forward upon depression of a push button. The plate hook 95 is open to be located at the position of the alternate long and short dashed line against the biasing force of the torsion coil spring 96. When the holder 94 is urged against a cover 99 by the upper end of the plate hook 95, the plate trailing edge holding unit 93 as a whole is prevented from upward movement against the tension of the leaf spring 92. Reference numeral 100 denotes a sensor consisting of a light-emitting element and a light-receiving element and located near the air cylinder 97. The sensor 100 detects the leading edge of the plate 89 entering between the guide plates 88, and the piston rod 98 of the air cylinder 97 is moved backward to cause the plate hook 95 to stand against the elastic force of the torsion coil spring 96. The bent portion of the plate 89 is hooked by the plate hook 95, and at the same time, locking by the holder 94 is released, so that the plate trailing edge holding unit 83 as a whole is moved upward together with the plate 89 by the tension of the leaf spring 92. Therefore, the plate 89 is pulled into the loader 83. A pin 102 is slidably supported in a hole of a block 101 arranged in correspondence with the plate hook 95 at the upper end portion of the loader 83 and is biased in a direction to be removed from the block 101 by a compression coil spring 103. This pin 102 is pushed against the elastic force of the compression coil spring 103 to incline the upper end portion of the plate hook 95 as indicated by the alternate long and short dashed line, thereby releasing the bent portion of the plate 89. Therefore, the plate 89 can be removed from the loader 83.

A plate feed unit will be described below. Upper-, middle- (not shown), and lower-stage suction pads 104 (each stage consists of a plurality of pads) for chucking a new plate 105 to be fed to the plate cylinder 1 in place of the old plate 89 are connected to a suction air source and are arranged on the surface of the loader 83. The lower-stage suction pads 104 are vertically movable. That is, a pair of right and left air cylinders 106 are supported on both side plates of the loader 83 through brackets 107 above the lower-stage suction pads 104. The suction pads 104 are mounted in tandem with each other on a bar 109, both ends of which are fixed to piston rods 108 of the air cylinders 106. When the piston rods 108 are moved forward, the bar 109 which holds the new plate 105 is moved from a position indicated by the solid line to a position indicated by the alternate long and short dashed line, so that the new plate 105 is fed to the leading-side lockup device 5 which is open to the leading edge of the new plate 105. Reference numerals 110 denote racks fixed on the right and left side plates of the loader 83 and meshed with pinions 111 at the two ends of the bar 109 to smoothly move the bar 109 backward. Reference numeral 112 denotes a reference pin slidably fitted in a hole of another bar 113 and biased by a compression coil spring 114 to extend to be fitted in a reference hole of the new plate 105, thereby positioning the new plate 105.

Roller arms 116 are fixed at both side portions of an arm shaft 115 extending from the loader 83 at the lower end portion of the loader 83, while the arm shaft 115 is pivotally supported. A plurality of brush-like rollers 118 are pivotally mounted in tandem with each other on a roller shaft 117 supported between the free end portions of the arms 116. A lever 123 is fixed through a connecting plate 122 to the actuation end of a piston rod 121 of an air cylinder 120 fixed to one widthwise end of the loader 83 through a bracket 119. The free end portion of a lever 124 fixed on the arm shaft 115 is mounted on the lower end portion of the lever 123. With this arrangement, when the piston rod 121 of the air cylinder 120 is reciprocated, the arm 116 can be pivoted in the range between a storage position indicated by the solid line in FIG. 9 and an in-operation position indicated by the alternate long and short dashed line. In the in-operation position, the roller 118 is brought into tight contact with the new plate 105 on the plate cylinder 1, and the inner surface of the plate 105 is brought into tight contact with the outer circumferential surface of the plate cylinder 1. At the same time, the bent portion of the trailing edge of the new plate 105 is inserted into the open trailing-side lockup device 30. A plurality of brush-like rollers 125 are arranged in tandem with each other on the arm shaft 115 and are brought into slidable contact with the new plate 105 so as to guide it to the plate lockup device 5. Reference numerals 126 denote form rollers (generally at least four rollers) of an inking apparatus brought into contact with the plate surface on the plate cylinder 1 to apply an ink to the plate surface.

The units and apparatuses described above and a servo motor for rotating the plate cylinder 1 are connected through a control unit (not shown) and are operated at predetermined timings.

Figure 12A:
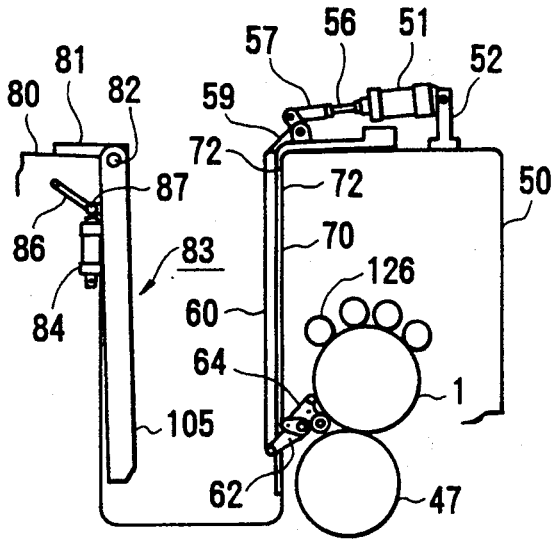
Figure 12B:
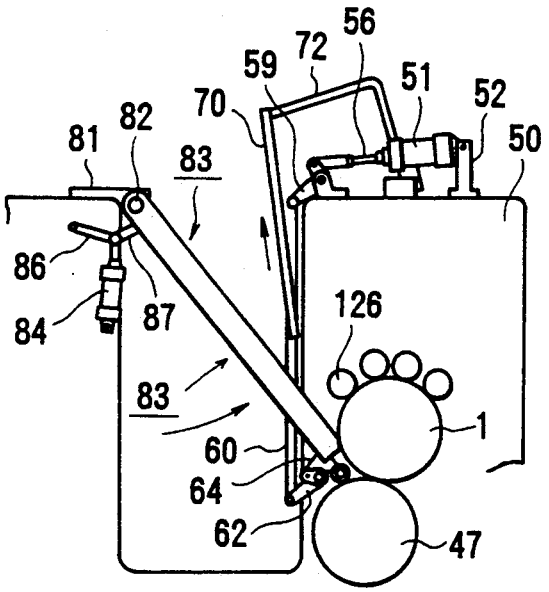

An operation of the plate replacing apparatus having the plate holding unit will be described below. During printing, as shown in FIG. 12A, the loader 83 is suspended from the support shaft 82. In this state, the new plate 105 is chucked by the upper-, middle-, and lower-stage suction pads 104, and the reference pin 112 is fitted in the reference hole, so that the new plate 105 is positioned and mounted in the loader 83. The plate trailing edge holding unit 93 in the loader 83 is manually moved downward. When the air cylinder 97 is operated with the push button, the piston rod 98 is moved forward to urge the plate hook 95. The plate hook 95 is inclined as indicated by the alternate long and short dashed line in FIG. 8 and is thus opened.

Figure 12C:
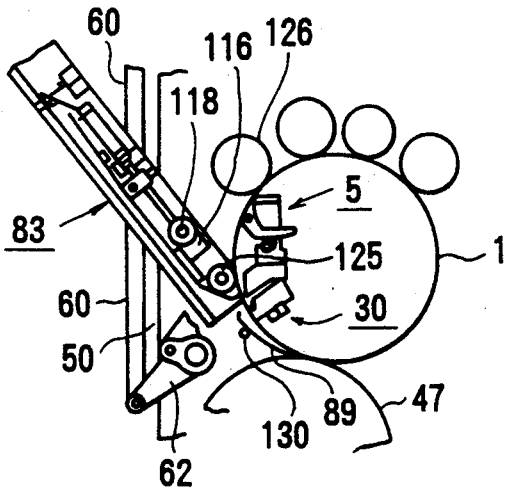

When printing is completed and the old plate 89 is to be replaced with the new plate 105, a start button is depressed. The air cylinder 73 is actuated to open the cover 70 through the L-shaped lever 72, as indicated by the alternate long and short dashed line in FIG. 11. At the same time, the air cylinder 84 is actuated to incline the loader 83 to a plate replacement position of FIG. 12B, through the levers 86 and 87. In this case, as shown in FIGS. 12C and 9, the trailing-side lockup device 30 opposes the distal end portion of the loader 83. At the same time, as shown in FIG. 7, the right roller 67 opposes the distal end portion of the lever 54 on the cam 38. The left roller 67 opposes the lever 53A on the cam shaft 19 which is in phase with the lever 54. In this state, when the right and left air cylinders 51 are simultaneously actuated, the leading- and trailing-side lockup devices 5 and 30 are simultaneously opened upon rotation of the cam 38 and the cam shaft 19.

Figure 12D:
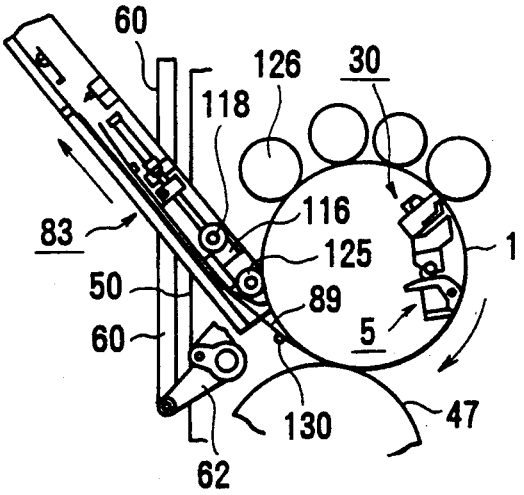

In this state, the trailing edge portion of the old plate 89 is popped up by its rigidity from the trailing-side lockup device 30 and abuts against a guide 130, as shown in FIG. 12C. The plate cylinder 1 is pivoted in a direction opposite to the direction of the arrow in FIG. 9, so that the trailing edge of the old plate 89 is inserted between the guide plates 88 of the loader 83. When the inserted old plate 89 passes through the sensor 100, the sensor 100 detects the plate and drives the air cylinder 97, so that the piston rod 98 is moved backward. The plate hook 95 then stands up, as indicated by the solid line in FIG. 8. As a result, the plate hook 95 hooks the trailing-edge bent portion of the old plate 89, locking of the holder 94 is released, and the plate trailing-edge holding unit 93 as a whole is moved upward by a tension accumulated by each leaf spring 92 arranged on the corresponding convex member 91. The old plate 89 held on the plate hook 95 is pulled and stored into the loader 83. FIG. 12D shows a state during removal of the old plate 89.

Figure 12E:
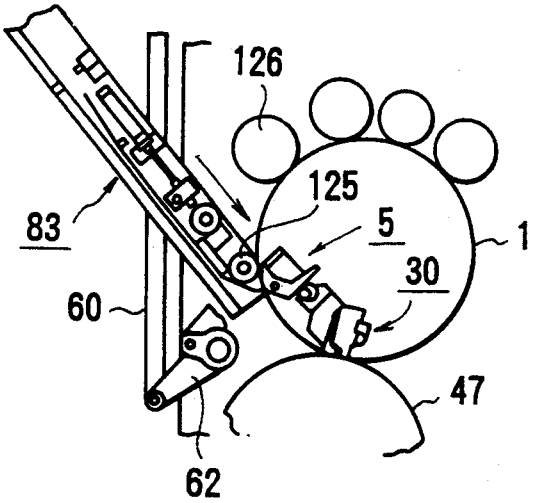

When the plate removal is completed, the servo motor is operated to slightly pivot the plate cylinder 1, and the plate cylinder 1 is stopped so that the open plate gripper surface of the leading-side lockup device 5 reaches a line extended from the new plate 105 and held on the loader 83, as shown in FIG. 9. At the same time, the air cylinder 106 is actuated to rotate the pinions 111 on the racks 110, so that the bar 109 is moved downward. The new plate 105 held by the lower-stage suction pads 104 is guided in slidable contact with the rollers 125. The leading edge of the new plate 105 is inserted into the leading-side lockup device 5. At this time, the lever 53 shown in FIG. 7 is located at the position of the alternate long and short dashed line and opposes the roller 67. When the air cylinder 51 is actuated, the cam shaft 19 is rotated together with the lever 53 to close the leading-side lockup device 5, and the new plate 105 is gripped by the leading-side lockup device 5. This state is shown in FIG. 12E.

Figure 12F:
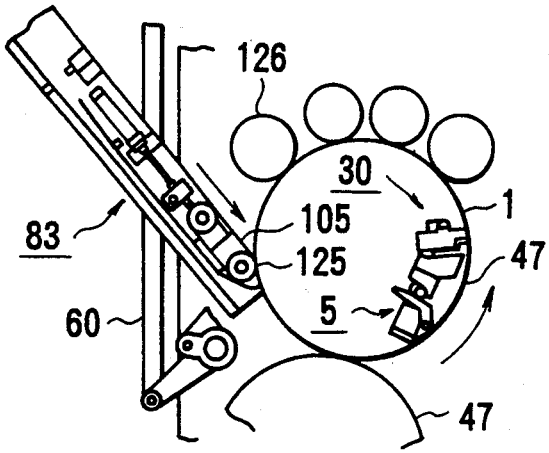
Figure 12G:
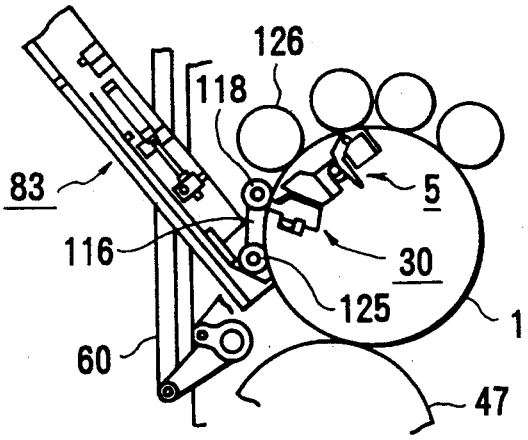

When the servo motor is operated in this state to pivot the plate cylinder 1 in the direction of the arrow, the new plate 105 is wound around the circumferential surface of the plate cylinder 1, and the trailing edge of the new plate 105 is stopped at a position corresponding to the roller 118. Thereafter, the air cylinder 120 is actuated to move the piston rod 121 backward. The arm 116 is pivoted through the levers 123 and 124, and the brush-like rollers 118 are brought into tight contact with the circumferential surface of the plate cylinder 1, thereby inserting the trailing-edge bent portion of the new plate 105 into the trailing-side lockup device 30 by the rollers 118. During rotation of the plate cylinder 1, the rollers 125 are rotated in rolling contact with the surface of the new plate 105. Therefore, the new plate 105 is brought into tight contact with the circumferential surface of the plate cylinder 1. FIG. 12F shows a state during rotation of the plate cylinder 1. FIG. 12G shows a state after rotation. When the trailing-edge end portion of the new plate 105 is inserted into the trailing-side plate lockup device 30, the left air cylinder is operated. In this case, the lever 54 has already been returned to the position indicated by reference numeral 54A. The roller urges the lever 54A downward, and the pivotal movement of the cam 38 causes closing of the trailing-side plate lockup device 30, thereby gripping the inserted end of the new plate 105. At the end of pivotal movement of the cam 38, the gripper plates 36 and the lockup tables 35 become integral with each other and move together in the circumferential direction of the plate cylinder 1. The new plate 105 is thus kept taut and is brought into tight contact with the circumferential surface of the plate cylinder 1.

Figure 12H:
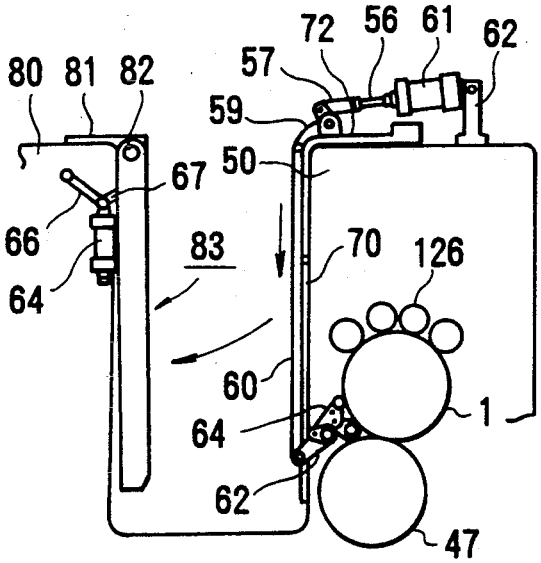
Figure 13:
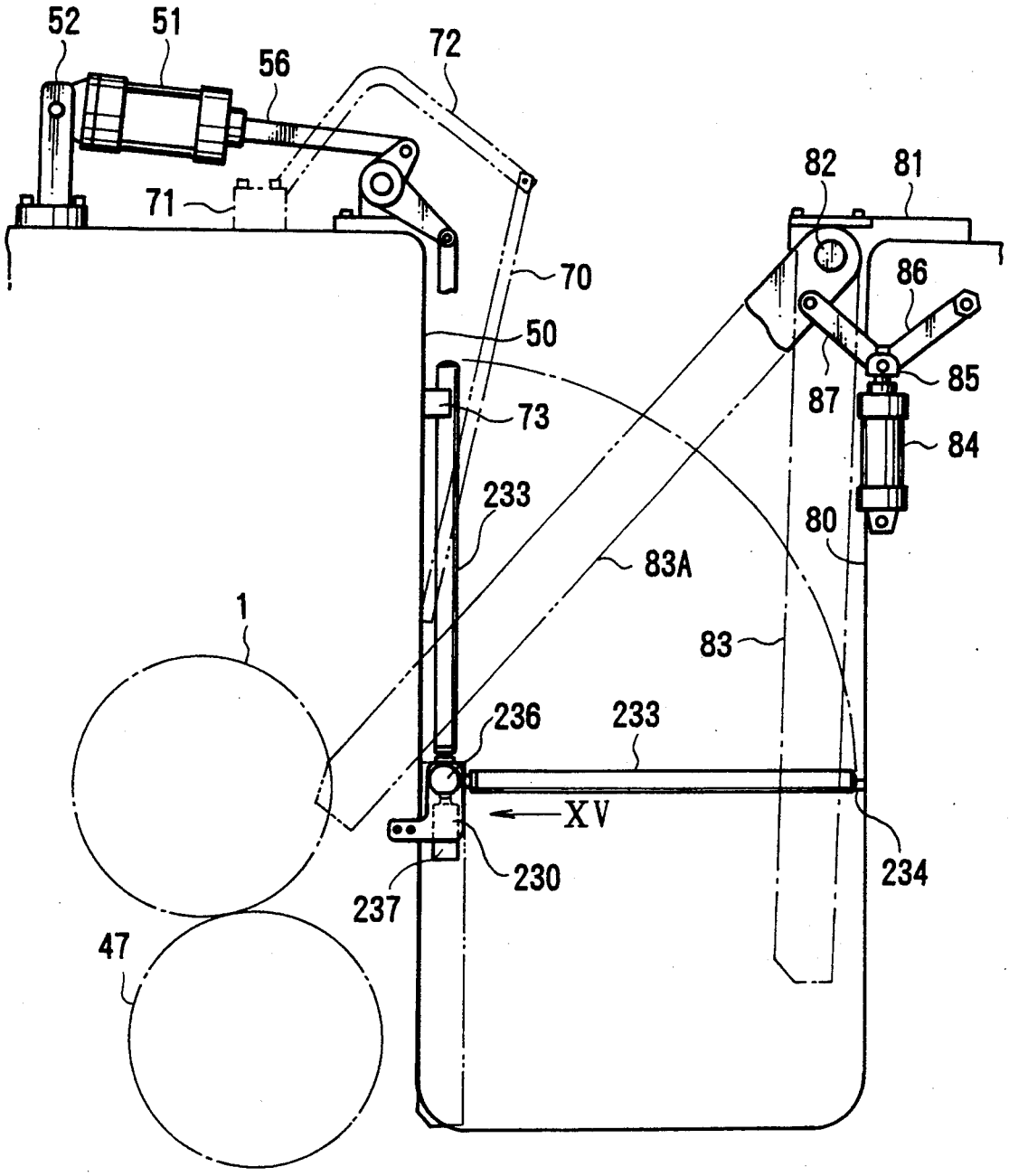
Figure 17:
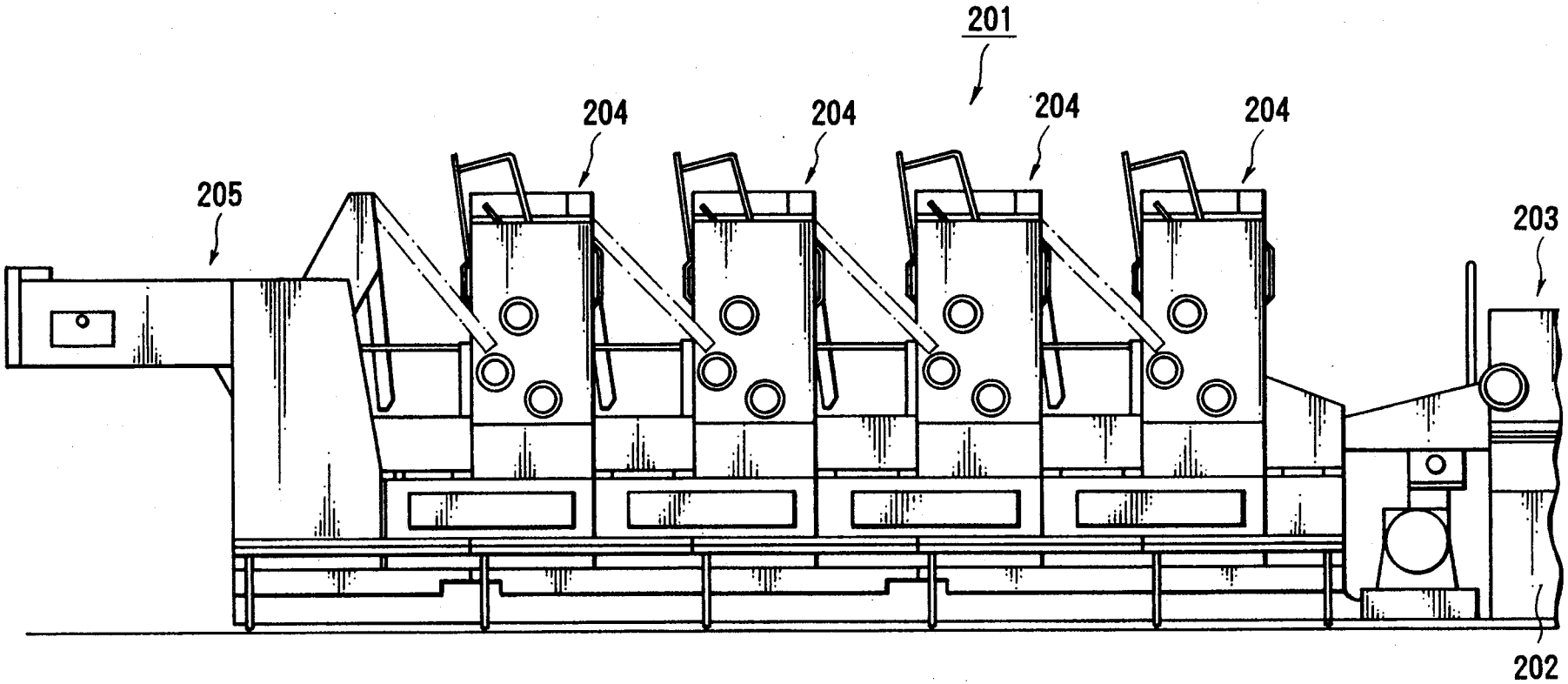

The piston rod 85 of the air cylinder 84 is moved backward to pull the levers 86 and 87. The loader 83 is moved downward to the stored state, as shown in FIG. 12H. The cover 70 is covered upon operation of the air cylinder 73. Therefore, printing can be restarted.

After printing is restarted, when the pin 102 is pushed at the front side of the loader 83 at a proper timing, the plate hook 95 is inclined to release the old plate 89. The old plate 89 is removed from the loader 83. As described above, the new plate 105 can be mounted on the loader 83 to stand by. A space between the printing units is not reduced in the stored state of the loader 83.

FIGS. 13 to 17 show a plate replacing apparatus according to another embodiment of the present invention.

Members except for those of a safety unit in FIGS. 13 to 17 are identical to those in FIGS. 1 to 12H. The same reference numerals denote the same parts throughout these drawings, and a detailed description thereof will be omitted.

Referring to FIGS. 13 to 17, a printing press 201 comprises a paper feed unit 203 having a paper stacker for stacking sheets 202 thereon and a paper feeder for feeding the sheets 202 one by one, and a delivery unit 205 having a stack board for stacking printed matters printed by each printing unit 204. Each printing unit 204 has printing cylinders (e.g., a plate cylinder 1 and a blanket cylinder 47), an inking unit, and a dampening unit.

A safety unit is arranged in the plate replacing apparatus to protect an operator from a loader 83. L-shaped brackets 230 are fixed on right and left frames 50 of each of the printing units 204 at positions substantially the same height as that of the axis of the plate cylinder 1 so as to oppose the side on which the loader 83 is mounted. A support shaft 232 is pivotally supported on the brackets 230 so that axial movement of the support shaft 232 is restricted by collars 231. Each safety bar 233 having a rod-like shape and almost the same length corresponding to a distance between the adjacent frames 50 is disposed at the extended end portion of the corresponding support shaft 232 extending from the bracket 230. The safety bar 233 is pivoted together with the corresponding support shaft 232 to be horizontal to close a space of the printing press between the frames 50. However, when the safety bar 233 is pivoted and stands upright, the space is released. Reference numeral 234 denotes a pin extending on the corresponding frame 50 and fitting in a groove of the corresponding safety bar 233 to horizontally fix the safety bar 233. Reference numeral 235 denotes a holder fixed on the frame 50 to clamp and hold the safety bar 233 upright. A cam 236, the circumferential surface of which is partially chamfered, is integrally fixed on the corresponding support shaft 232. A limit-switch 237 connected in series with an air cylinder 84 for driving the loader 83 is arranged to oppose the cam 236. As a result, when the safety bar 233 is set horizontal, the chamfered portion of the cam 236 opposes the contact to turn on the limit switch 237, thereby actuating the air cylinder 84. When the safety bar 233 stands upright, an arcuated portion of the cam 236 opposes the contact. In this case, the limit switch 237 is turned off, and the air cylinder 84 is disabled.

An operation of the plate replacing apparatus having the above structure will be described below. During printing, the loader 83 is suspended from a swing shaft 82 and is stored. In this state, the safety bar 233 stands upright and is clamped by the holder 235. The arcuated portion of the cam 236 is kept in contact with the contact of the limit switch 237,.and the air cylinder 84 is kept disabled. During the printing operation, the operator enters the space between the printing units to hold a new plate in the loader 83. The loader 83 is not accidentally pivoted, thus ensuring a safe operation. Upon completion of printing, when the old plate is to be replaced with a new one, the safety bar 233 is held horizontal and is fixed by the pin 234 to enable the air cylinder 84. When a start button is depressed, each air cylinder is operated to open a cover 70 in the illustrated manner. The air cylinder 84 is actuated to incline the loader 83 toward the plate replacing apparatus through levers 86 and 87. The servo motor is rotated by a predetermined angle until the plate cylinder 1 is located to the plate discharge position. When right and left air cylinders 51 are simultaneously actuated, the gripper surfaces of the trailing-side lockup device 5 are opened, and at the same time, the gripper surfaces of the leading-side lockup device 30 are also opened. The plate released from the lockup devices is released into a loader 83A upon pivotal movement of the plate cylinder 1 and the operation of the delivery unit in the loader 83A. A new plate is mounted on the plate cylinder 1 by pivotal movement of the plate cylinder 1, opening/closing of the plate lockup apparatus, and the operation of the plate feed unit in the loader 83A. During plate replacement, since the safety bar 233 is held horizontal and closes the space between the printing units, the operator cannot enter this space, thus ensuring a safe operation. Upon completion of plate replacement, the loader 83A is suspended, and the safety bar 233 is opened. The air cylinder 84 is set disabled. The operator enters the space between the printing units and removes the old plate from the loader 83. The next plate is held in the loader 83. In this case, the loader 83 is not accidentally pivoted, thus ensuring a safety operation.

In this embodiment, the safety bar is pivotally arranged and is actually pivoted to open/close the working space between the printing units. However, the safety bar may be axially reciprocated to open/close the space. In this embodiment, the plate holding member holds the old and new plates. However, the plate holding member may hold one of the old and new plates.

FIGS. 18 to 22 show a plate replacing apparatus according to still another embodiment of the present invention. The arrangement of the plate replacing apparatus of this embodiment is substantially the same as that of the above embodiment except for a support structure for a plate holding member. The same reference numerals as in FIGS. 1 to 17 denote the same parts in FIGS. 18 to 22, and a detailed description of thereof will be omitted.

Referring to FIGS. 18 to 22, each printing unit 302 comprises an inking unit (not shown), a dampening water unit 307 consisting of a water pan 305 and rollers 306. A pair of right and left rectangular parallelepiped brackets 309 are fixed on the upper end faces of frames 50 obliquely above a plate cylinder 1. U-shaped bearing grooves **309*a* open upward are formed in these brackets 309. A loader 83 serving as a plate holding member having a rectangular shape with a length almost equal to the axial length of the plate cylinder 1 is swingably arranged in the bearing grooves 309*a* through roller bearings 311. The roller bearings 311 are pivotally mounted on the proximal portion of the loader 83 so as to be vertically detachable. Air cylinders 84 connected to a control unit are swingably supported on the right and left frames 50 near the brackets 309. A lever 86 pivoted on the frame 50 and a lever 87 pivoted on the loader 83 are connected to the actuation end of a piston rod 85. When the piston rod 85 of the air cylinder 84 is reciprocated, the loader 83** is swung through the levers 86 and 87. More specifically, the loader 83 is swung between a suspended position representing a stored position indicated by reference numeral 83B and an inclined position indicated by reference numeral 83A, so that the distal end portion of the loader 83 is moved to come close to or to be separated from the circumferential surface of the plate cylinder 1. An old plate holding unit is arranged inside the loader 83 to incline the loader 83 to the position indicated by reference numeral 83A to perform opening/closing of the plate lockup devices and pivotal movement of the plate cylinder 1. The unnecessary old plate removed from the plate cylinder 1 enters a loader 83A and is held therein. A plate feed unit is arranged inside the loader 83A, and the new plate held within the loader 83A is mounted on the plate cylinder 1 in an order opposite to that of plate removal.

Figure 21:
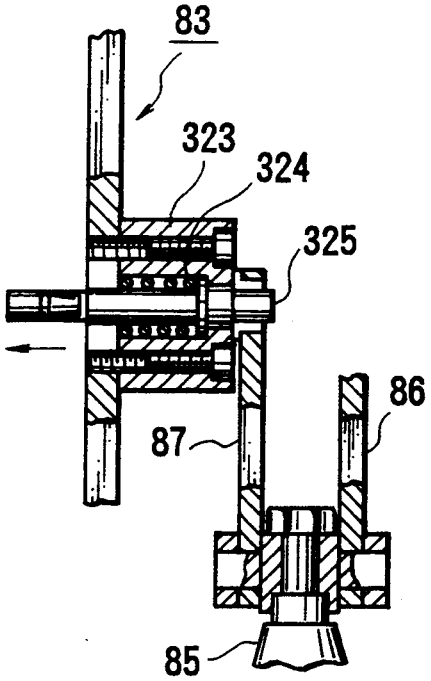
Figure 22:
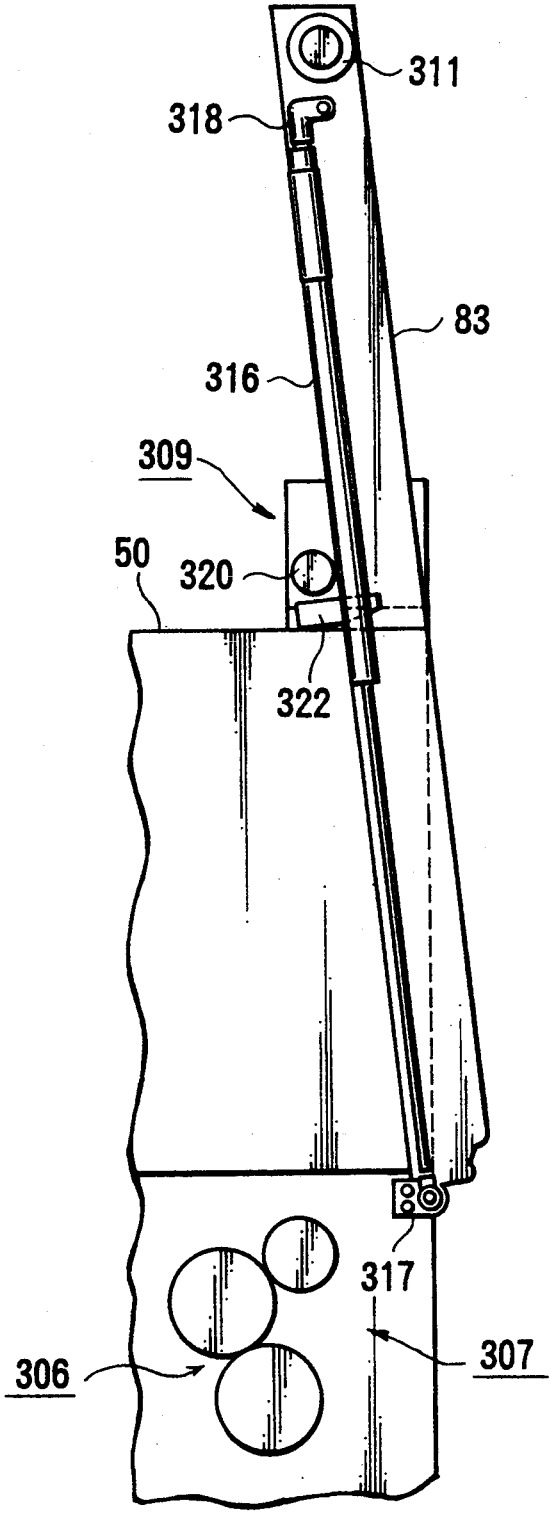

An apparatus for moving the loader 83 upward to open the working surface of the dampening unit 307 is arranged in the plate replacing apparatus. The proximal end portions of gas springs 316 serving as spring members having large strokes are pivotally supported on the right and left frames 50 of each printing unit 302 through brackets 317 fixed near the upper end portions of the dampening unit 307. The upper end portion of the gas spring 316 is pivotally mounted on the loader 83 through an L-shaped metal piece 318. With this arrangement, the loader 83 is kept biased upward by the gas spring 316 so that a state shown in FIG. 22 is an upper limit. Upon movement of the loader 83 to the upper limit, the working surface of the dampening unit 307 is entirely opened. Reference numeral 319 denotes a stop lever pivotally supported on the upper end face of the bracket 309 and can be pivoted between the solid line and the alternate long and short dashed line in FIG. 19. When the stop lever 319 is pivoted to the position indicated by the solid line while the loader 83 is moved downward against the elastic force of the gas spring 316, upward movement of the loader 83 is prevented. Reference numeral 320 denotes a guide roller which is pivotally fitted at the distal end portion of a pin 321 extending from the bracket 309 and is brought into rolling contact with the loader 83, thereby vertically guiding the loader 83. Reference numeral 322 denotes a guide extending from the bracket 9 to vertically guide the gas spring 316. A bearing 323 shown in FIG. 21 is fixed to a pivot portion of a lever 315 on the side of the loader 83. An L-shaped pin 325 biased toward a lever 315 by a compression coil spring 324 is axially supported within this bearing 323. The distal end portion of the pin 325 is detachably inserted into the pin hole of the lever 315. With this arrangement, when the pin 325 is removed from the pin hole of the lever 87 against the elastic force of the compression coil spring 324, the loader 83 can be vertically moved. A limit switch 326 connected to a control unit is supported on the bracket 309 near the roller bearing 311 of the loader 83 located in the stored state. The printing press can be operated only when the loader 83 is kept at the lower position.

An operation of the plate replacing apparatus having the above arrangement will be described below. During printing, the loader 83 is kept suspended in a stored state while the bearings 311 are fitted in the bearings 309*a* of the brackets 309, as indicated by reference numerals 83A and 83B. Upward movement of the loader 83 is prevented by the stop lever 319.

Figure 18:
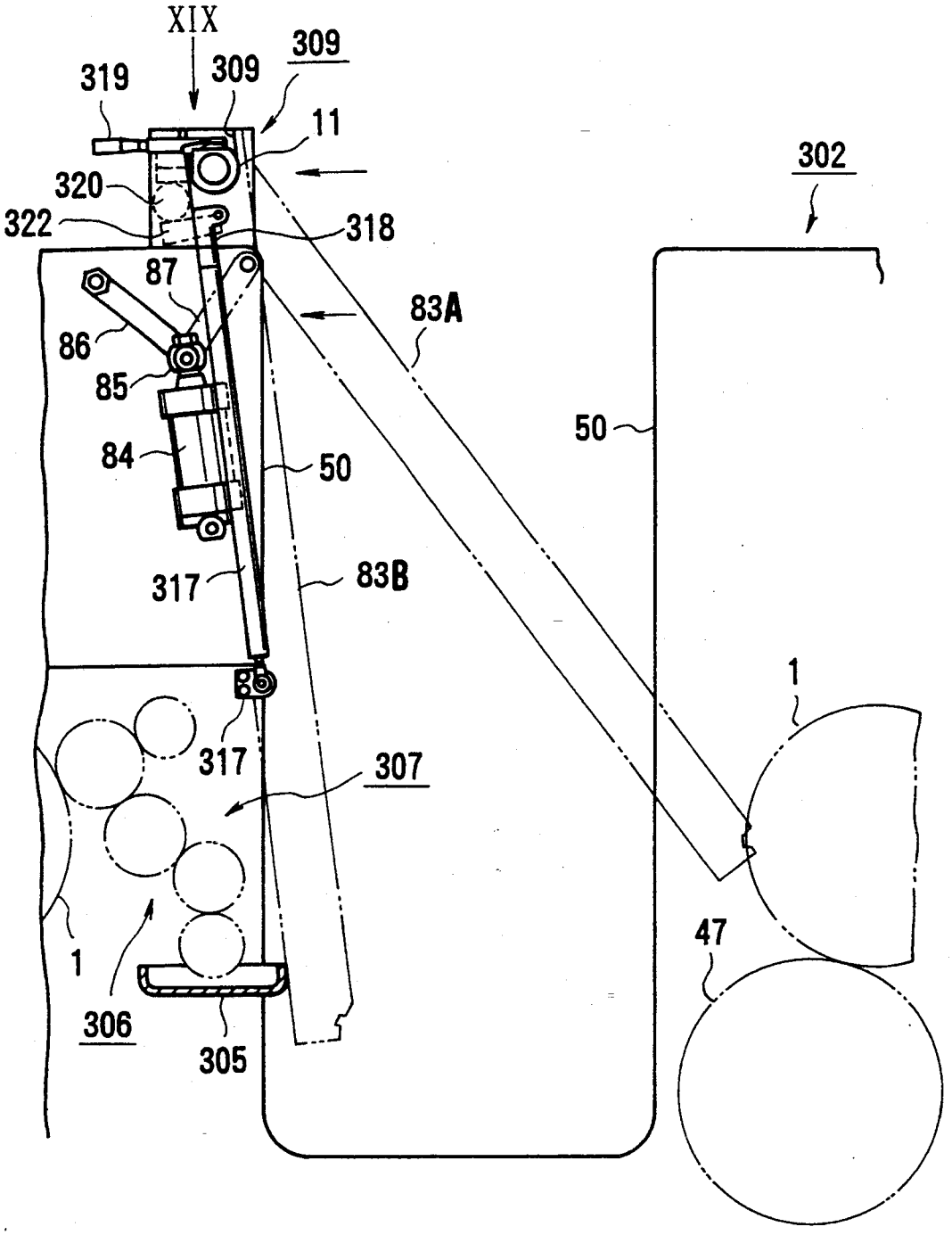
Figure 19:
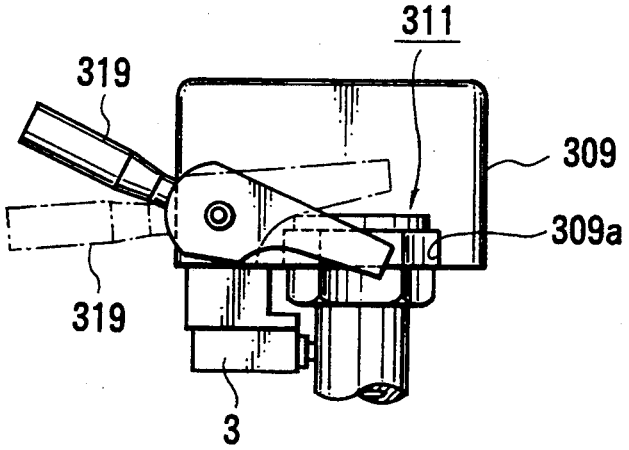
Figure 20:
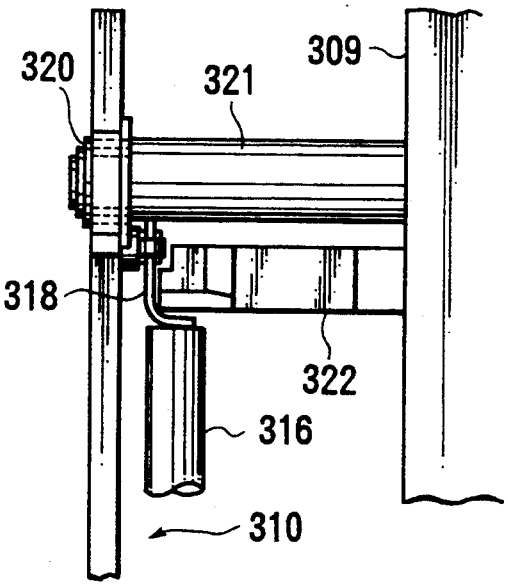

When the old plate is to be replaced with a new plate upon completion of printing, and when a start button is depressed, the loader 83 is inclined to the plate replacement position indicated by reference numeral 83A in FIG. 18 through the levers 86 and 87 upon actuation of the air cylinder 84. The servo motor is rotated to pivot the plate cylinder by a predetermined angle so as to locate it to the plate removal position. At this time, the right and left air cylinders are simultaneously actuated, and the plate gripping surfaces of the trailing-side lockup device are open. The plate released from this gripping is removed into the loader 83A upon pivotal movement of the plate cylinder and the actuation of the plate removal unit in the loader 83A. The new plate held in the loader 83A beforehand is mounted on the plate cylinder by pivotal movement of the plate cylinder, opening/closing of the plate lockup devices, and the operation of the paper delivery unit in the loader 83A. Upon completion of plate replacement, the loader 83A is set suspended, and the operator enters the space between the printing units. The old plate in the loader 83 is removed, and the next plate is held in the loader.

When the dampening unit 307 is subjected to maintenance or inspection, or when dampening water is supplied to the water pan 305, the pin 325 is pulled in the direction of the arrow in FIG. 21 to disengage the lever 87 from the loader 83. The stop lever 319 is pivoted to the position indicated by the alternate long and short dashed line in FIG. 19. The loader 83 is then released from the stop lever 319, so that the loader 83 is moved upward to the illustrated position in FIG. 22 while being guided by the guide roller 320 and the guide 322. As a result, the working surface of the dampening unit 307 is entirely opened.

In the above embodiment, the plate holding member holds both the old and new plates. However, the plate holding member may hold either the new or old plate. In addition, the spring member for moving the plate holding member upward and the member for holding the plate holding member to the lower position and preventing it from moving upward need not be arranged.

A plate replacing apparatus for a printing press according to the present invention, as has been described above, comprises an old plate holding mechanism for receiving and holding an old plate removed upon release of the plate fixing unit and rotation of the plate cylinder, and a new plate holding mechanism for replacing the old plate with a new plate and holding the new plate supplied to the plate cylinder. The new plate can be placed to stand by and the old plate can be removed from the plate cylinder during a time interval except for the plate replacement time. The preparation time can be greatly shortened, and productivity can be improved. At the same time, the plate need not be manually held, thereby reducing the labor. The plate holding apparatus is swingably supported about a printing press fulcrum located obliquely above the plate cylinder so that the distal end portion of the plate holding unit can be moved to come close to or to be separated from the circumferential surface of the plate cylinder. The same space as in the case wherein the plate holding unit is not arranged can be assured between the adjacent printing units. Plate replacement, ink replenishment, and maintenance operations can be facilitated, and workability is not degraded.

In the present invention, a plate holding member is arranged to be driven by an actuator between an actuation position wherein the distal end of the unit comes close to the plate lockup device and a stored position wherein the distal end is separated from the plate lockup device. A safety bar is arranged to cross and close the space formed between the printing units, and a series-connected switch is arranged between the safety bar and the actuator. Automatic plate replacement between the old and new plates can be facilitated, and energy saving can be achieved. The preparation time can be shorted to improve the productivity. At the same time, when the safety bar in the safety unit is open, the switch is turned off to prevent pivotal movement of the loader. However, when the safety bar is closed, the loader is pivoted. In this case, the operator cannot enter the space between the printing units due to the presence of the safety bar, thereby improving the safety in operation.

According to the present invention, a plate holding member is arranged to be movable toward the printing press and vertically movable between the actuation position where the distal end portion comes close to the plate lockup device and the stored position where the distal end portion is separated from the plate lockup device. Plate replacement between the old and new plates can be easily automated, and energy saving is achieved. The preparation time can be shortened to improve the productivity. Since the plate holding member is moved upward to entirely open the working surface of the dampening unit, maintenance and inspection of the dampening unit, supply of dampening water to the water pan, and replacement of rollers can be facilitated, thereby improving workability and safety.

What is claimed is:

1. An automatic plate replacing apparatus which replaces an old plate with a new plate in a printing unit of a printing press, the printing press having a frame which supports the contents of least one printing unit, the printing unit having a plate cylinder with a circumferential surface having plate lockup devices disposed within a gap of the circumferential surface for engaging a plate wound around the circumferential surface, the automatic plate replacing apparatus comprising:

a loader arm, with a proximate end and a distal end, the proximate end coupled to the frame by a fulcrum, the fulcrum disposed obliquely above the plate cylinder so that the distal end of the loader arm is separated from the circumferential surface of the plate cylinder;

an old plate holding mechanism using the loader arm for receiving and holding the old plate disengaged from the plate lockup devices in the circumferential surface of the plate cylinder;

a new plate holding mechanism using the loader arm for holding and feeding the new plate to the plate lockup devices in the circumferential surface of the plate cylinder;

an actuator means coupled between the frame and the loader arm for moving the loader arm between a stored position, where the loader arm is separated from the circumferential surface of the plate cylinder and an actuation position, where the loader arm is proximate to the circumferential surface of the plate cylinder;

a plate replacement unit coupled to the frame and to the printing unit integrating the old plate holding mechanism with the new plate holding mechanism so that the plate replacement unit operates the old plate holding mechanism and the new plate holding mechanism while the loader arm continuously maintains the actuation position.

2. An apparatus according to claim 1, wherein the plate replacement unit moves upward from the frame of the printing press while the loader arm is in the stored position, where the loader arm is separated from the circumferential surface of the plate cylinder.

3. An automatic plate replacing apparatus which replaces an old plate with a new plate for each of several printing units of a printing press, each printing unit having a frame which supports the components of a printing unit, a plate cylinder with a circumferential surface having plate lockup devices disposed within a gap of the circumferential surface for engaging a plate wound around the circumferential surface, the automatic plate replacing apparatus for a first printing unit of several printing units comprising:

a loader arm, with a proximate end and a distal end, the proximate end coupled to the frame of the first printing unit by a fulcrum, the fulcrum disposed obliquely above the plate cylinder so that the distal end of the loader arm is separated from the circumferential surface of a plate cylinder of a second printing unit of several printing units adjacent to the first printing unit;

an old plate holding mechanism using the loader arm for receiving and holding the old plate disengaged from plate lockup devices in the circumferential surface of the plate cylinder of the second printing unit;

a new plate holding mechanism using the loader arm for holding and feeding the new plate to the plate lockup devices in the circumferential surface of the plate cylinder of the second printing unit;

an actuator means coupled between the frame of the first printing unit and the loader arm of the first printing unit for moving the loader arm between a stored position, where the loader arm is separated from the circumferential surface of the plate cylinder of the second printing unit, and an actuation position, where the loader arm is proximate to the circumferential surface of the plate cylinder of the second printing unit;

a plate replacement unit coupled to the frame of the second printing unit integrating the old plate holding mechanism with the new plate holding mechanism so that the plate replacement unit operates the old plate holding mechanism and the new plate holding mechanism while the loader arm continuously maintains the actuation position.

4. An apparatus according to claim 3, wherein the plate replacement unit moves upward away from the frame of the printing unit while the loader arm is in the stored position, where the loader arm is separated from the circumferential surface of the plate cylinder.

5. An apparatus according to claim 3, wherein the plate replacement unit crosses a working space disposed between the frames of adjacent printing units during movement of the loader arm by the actuator means, the printing press further comprising a safety bar coupled to the frame of each of several printing units for crossing and closing the working space, the safety bar movable between an open position where an operator can enter the working space and a closed position where the operator cannot enter the working space; and a switch which inhibits the plate replacement unit from crossing the working space when the safety bar is in the open position.

6. An automatic plate replacing apparatus which replaces an old plate with a new plate for each of several printing units of a printing press, the printing press having a frame which supports the components of at least two adjacent printing units, the adjacent printing units each having a plate cylinder with a circumferential surface having plate lockup devices disposed within a gap of the circumferential surface for engaging a plate wound around the circumferential surface, the automatic plate replacing apparatus comprising:

a loader arm, with a proximate end and a distal end, the proximate end coupled to the frame of one of the at least two adjacent printing units by a fulcrum, the fulcrum disposed obliquely above the plate cylinder so that the distal end of the loader arm is separated from the circumferential surface of the plate cylinder;

an old plate holding mechanism using the loader arm for receiving and holding the old plate disengaged from plate lockup devices in the circumferential surface of the plate cylinder of the printing unit;

a new plate holding mechanism using the loader arm for holding and feeding the new plate to the plate lockup devices in the circumferential surface of the plate cylinder of the second printing unit;

an actuator means coupled between the frame and the loader arm for moving the loader arm between a stored position, where the loader arm is separated from the circumferential surface of the plate cylinder, and an actuation position, where the loader arm is proximate to the circumferential surface of the plate cylinder;

a plate replacement unit coupled to the frame integrating the old plate holding mechanism with the new plate holding mechanism so that the plate replacement unit operates both the old holding mechanism and then the new plate holding mechanism while the loader arm continuously maintains the actuation position, the plate replacement unit crossing a working space disposed between the frames of the at least adjacent printing units during movement of the loader arm by the actuator means;

at least one safety bar coupled to the frame of the printing press for crossing and closing the working space disposed between the frames of the at least adjacent printing units, the safety bar movable between an open position where an operator can enter the working space and a closed position where the safety bar extends between the at least two adjacent printing units to prevent the operator from entering the working space; and a switch which inhibits the plate replacement unit from crossing the working space when the safety bar is in the open position.

7. An apparatus according to claim 6, wherein the plate replacement unit moves upward away from the printing press while the loader arm is in the stored position, where the loader arm is separated from the circumferential surface of the plate cylinder.

* * * * *